US006261754B1

(12) United States Patent
Ishigaki et al.

(10) Patent No.: US 6,261,754 B1
(45) Date of Patent: Jul. 17, 2001

(54) HEAT DEVELOPABLE IMAGE RECORDING MATERIAL

(75) Inventors: Kunio Ishigaki; Takahiro Ishizuka, both of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/482,276

(22) Filed: Jan. 13, 2000

(30) Foreign Application Priority Data

Jan. 13, 1999 (JP) ..... 11-006872
May 24, 1999 (JP) ..... 11-143058

(51) Int. Cl.[7] ..... G03C 1/498

(52) U.S. Cl. ..... 430/523; 430/264; 430/523; 430/531; 430/613; 430/614; 430/619

(58) Field of Search ..... 430/619, 523, 430/531, 264, 613, 614

(56) References Cited

FOREIGN PATENT DOCUMENTS

0902322A1 3/1999 (EP) .
59-13728 3/1984 (JP) .
8137045A 5/1996 (JP) .
WO 9704355 2/1997 (WO) .

*Primary Examiner*—Thorl Chea
(74) *Attorney, Agent, or Firm*—Birch, Stewart, Kolasch & Birch, LLP

(57) ABSTRACT

A heat developable image recording material is disclosed in which having at least one image forming layer formed on a support, and a multilayered protection layer consisting of a lower protection layer formed adjacent to and on the image forming layer and at least one upper protection layer formed on the lower protection layer, wherein the lower protection layer comprises a polymer as a binder, in which I/O value of the polymer that is obtained by dividing inorganic value by organic value based on an organic conception diagram is equal to or less than 0.60, and wherein a ratio of the I/O value of the polymer contained as the binder of the lower protection layer to the I/O value of a polymer contained as a binder of the upper protection layer is less than 1.0. This heat developable image recording material has an improved post-heat-development adherence between the image forming layer and the protection layer formed on the image forming layer, prevents occurence of white powders, has an adequate film strength and dimentional stability, and reduces contact failures.

13 Claims, 1 Drawing Sheet

HEAT DEVELOPABLE IMAGE RECORDING MATERIAL

FIELD OF THE INVENTION

The present invention relates to a heat developable image recording material. More precisely, the present invention relates to an image recording material for scanners or image setters used for photomechanical processes and, more particularly, to a heat developable image recording material having a coated layer which exerts improved physical property after heat development.

BACKGROUND OF THE INVENTION

As one of the light exposure methods of photographic photosensitive materials, there has been known a image forming method of so-called scanner type, in which an original image is scanned and which a silver halide photographic material is light-exposed based on the obtained image signals to form a negative or positive image corresponding to the image on the original image.

As for a case where an image output from a scanner on a film is further printed directly on a printing plate without any reversal step, or a scanner light source having a soft beam profile, a light-sensitive material for scanners exhibiting ultra-high contrast property has been desired.

A large number of photosensitive materials having a photosensitive layer on a support for forming images upon imagewise exposure have been known. Among them, as a system for rendering preservation of environments and image forming means simplified, a technology for forming images by heat development is exemplified.

In recent years, reduction of the amount of waste processing solutions is strongly demanded in the field of photomechanical processes from the standpoint of environmental protection and space savings. To cope with this, techniques are needed in relation to photosensitive heat developable materials for use in photomechanical processes, which can be effectively exposed by a laser scanner or laser image setter and can form clear black images having high resolution and sharpness. Such heat developable photosensitive materials can provide to customers a heat development processing system, without use of solution-type processing chemicals, simpler and free from incurring environmental destruction.

Methods for forming an image by heat development are described, for example, in U.S. Pat. Nos. 3,152,904 and 3,457,075 and D. Morgan and B. Shely, Imaging Processes and Materials, "Thermally Processed Silver Systems", 8th ed., page 2, compiled by Sturge, V. Walworth and A. Shepp, Neblette (1969). The photosensitive material used contains a light-insensitive silver source (e.g., organic silver salt) capable of reduction, a photocatalyst (e.g., silver halide) in a catalytic activity amount, and a reducing agent for silver, which are usually dispersed in an organic binder matrix. This photosensitive material is stable at room temperature. However, when it is heated at a high temperature (e.g., 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

Such heat developable photosensitive materials of this type have been known previously, but in most of those sensitive materials, the photosensitive layer is formed by coating a coating liquid containing a solvent of an organic solvent such as toluene, methyl ethyl ketone (MEK), methanol, and the like. Use of such organic solvents as a solvent not only adversely affects human bodies during manufacturing processes but also is disadvantageous in term of costs for recycling the solvents and others.

To cope with this, a method has been considered in which a photosensitive layer (hereinafter referred also to as "aqueous photosensitive layer") is formed using a coating liquid of a water solvent not having the above problem. For example, Japanese Unexamined Patent Publication [KOKAI] (hereinafter referred simply to as "JP-A") Showa Nos. 49-52,626 and 53-116,144, and the like set forth an example that gelatin is used as a binder. Also, JP-A-50-151,138 sets forth an example that a poly vinyl alcohol is used as a binder.

In JP-A-60-28,737, an example that a gelatin and a polyvinyl alcohol are used together is described. In addition, as another example other than the above examples, JP-A-58-28,737 sets forth an example of a photosensitive layer that a water-soluble polyvinyl acetal is used as a binder.

Such a binder surely allows to form the photosensitive layer in use of a coating liquid with a water solvent, and brings advantages in terms of environments and costs.

However, if the hydrophilic polymer such as gelatin, polyvinyl alcohol, water-soluble polyvinyl acetal, and so on is used as the binder of the protection layer, adherence between the image forming layer and the protection layer on the image forming layer becomes very poor after the heat development, thereby raising a problem that the protection layer easily falls off. When a polymer latex having a high hydrophobic nature is used for the binder of the protection layer, the image forming layer shows some adherence after heat development but the heat development causes the added compounds to be deposited outside the layer, thereby raising a problem that white powdery stains (hereinafter, referred to as "white powders") occur.

It is an object of the invention to provide a heat developable image recording material for photomechanical processes, particularly for scanners or image setters, with improved adherence between the image forming layer and the protection layer formed on the image forming layer after the heat development and improved feature against occurrences of the white powders. Furthermore, it is another object of the invention to provide a heat developable image recording material with improvements in film strength adequate to prevent contact failures and with good dimentional stability.

SUMMARY OF THE INVENTION

The above objects are accomplished by means described below.

(1) A heat developable image recording material including: a support; at least one image forming layer formed on the support; and a multilayered protection layer consisting of a lower protection layer formed adjacent to and on the image forming layer and at least one upper protection layer formed on the lower protection layer, wherein the lower protection layer comprises a polymer as a binder, in which I/O value of the polymer that is obtained by dividing inorganic value by organic value based on an organic conception diagram is equal to or less than 0.60, and wherein a ratio of the I/O value of the polymer contained as the binder of the lower protection layer to the I/O value of a polymer contained as a binder of the upper protection layer is less than 1.0.

(2) The heat developable image recording material according to (1), wherein the lower protection layer contains a polymer having an I/O value of 0.10 to 0.55.

(3) The heat developable image recording material according to (1), wherein the ratio is from 0.4 to 0.8.

(4). The heat developable image recording material according to (1), wherein the image forming layer and the protection layer comprise a polymer latex as a binder.

(5) The heat developable image recording material according to (4), wherein 50% by weight or greater of the binder contained in the image forming layer is the polymer latex.

(6). The heat developable image recording material according to (4), wherein 80% by weight or greater of the binder contained in the image forming layer is the polymer latex.

(7) The heat developable image recording material according to (1), wherein the image forming layer contains an organic silver salt, a reducing agent, and a photosensitive silver halide.

(8) The heat developable image recording material according to (1), wherein a nucleation agent is at least one compound selected from substituted alkene derivatives represented by Formula (1), substituted isoxazole derivatives represented by Formula (2), specific compounds represented by Formula (3), and hydrazine derivatives, (1)

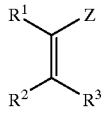

(2)

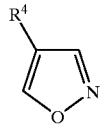

(3)

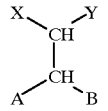

In Formula (1), $R^1$, $R^2$ and $R^3$ each independently represents a hydrogen atom or a substituent, Z represents an electron withdrawing group, and $R^1$ and Z, $R^2$ and $R^3$, $R^1$ and $R^2$, or $R^3$ and Z may be combined with each other to form a ring structure; in Formula (2), $R^4$ represents a substituent; and in Formula (3), X and Y each independently represents a hydrogen atom or a substituent, A and B each independently represents an alkoxy group, an alkylthio group, an alkylamino group, an aryloxy group, an arylthio group, an anilino group, a heterocyclic oxy group, a heterocyclic thio group or a heterocyclic amino group, and X and Y, as well as A and B may be combined with each other to form a ring structure.

(9) The heat developable image recording material according to (8), wherein the hydrazine derivative is a compound as represented by Formula (H), (H)

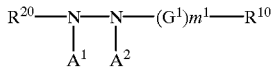

In formula, $R^{20}$ represents an aliphatic group, an aromatic group or a heterocyclic group, $R^{10}$ represents a hydrogen atom or a block group, $G^1$ represents —CO—, —COCO—, —C(=S)—, $—SO_2—$, —SO—, $—PO(R^{30})—$ (wherein $R^{30}$ is a group selected from the groups defined for $R^{10}$, and $R^{30}$ may be different from $R^{10}$), or an iminomethylene group, $A^1$ and $A^2$ both represent a hydrogen atom or either one represents a hydrogen atom and the other represents a substituted or unsubstituted alkylsulfonyl group, a substituted or unsubstituted arylsulfonyl group, or a substituted or unsubstituted acyl group, and $m^1$ represents 0 or 1 and when ml is 0, $R^{10}$ represents an aliphatic group, an aromatic group or a heterocyclic group.

(10) The heat developable image recording material according to (1), wherein at least one layer selected from a layer containing a metal oxide or a layer containing a surfactant including fluorine is formed on at least one side of the support.

(11) The heat developable image recording material according to (1), wherein the binder of the protection layer has a glass transition temperature of 25 to 100° C.

(12) The heat developable image recording material according to (1), further comprising, on each side of the support, an undercoating layer comprising a vinylidene chloride copolymer containing at least 70% by weight of vinylidene chloride monomer repeating units.

(13) The heat developable image recording material according to (1), wherein the image forming layer and/or the protection layer contains at least one type of plasticizers for controlling the lowest film forming temperature.

DETAILED DESCRIPTION OF THE INVENTION

Figure 1:
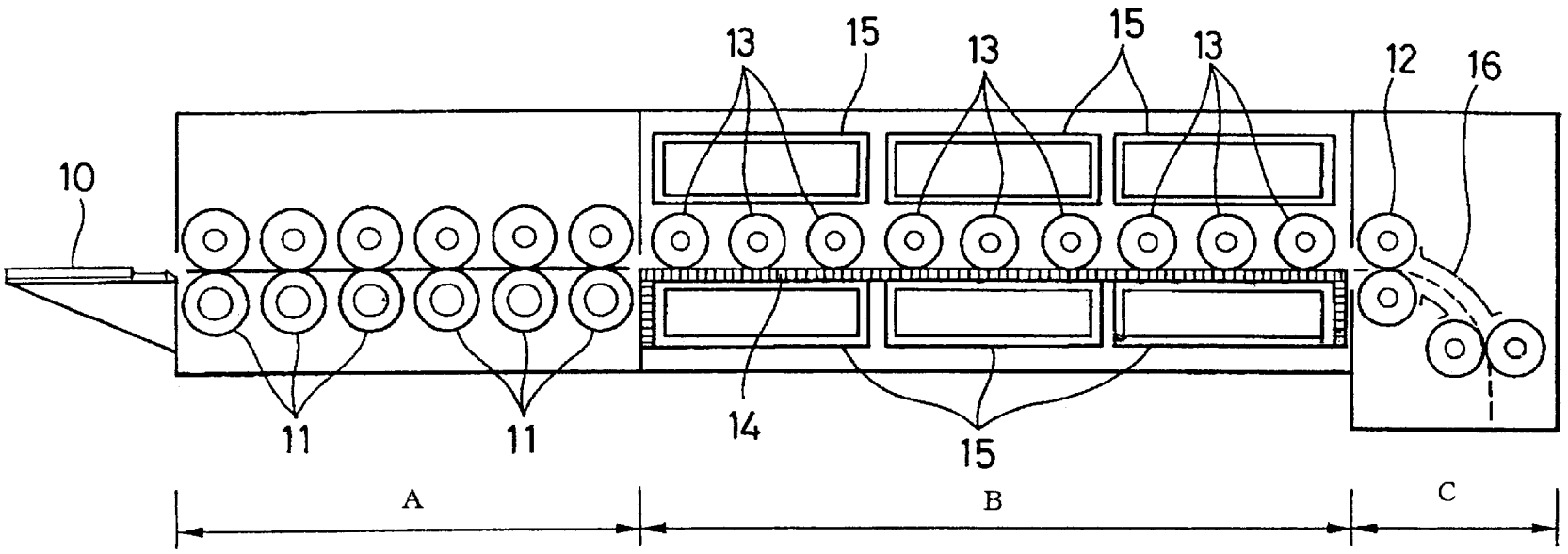
FIG. 1 is a side view showing a structure of a heat developing apparatus used in Examples.

Hereinafter, this invention is described in detail.

The heat developable image recording material according to the invention has at one image forming layer containing preferably an organic silver salt, a reducing agent, a photosensitive silver halide, and a nucleation agent, and has two or more protection layers including a protection layer (i.e., lower protection layer) formed adjacent to the image forming layer. In this situation, the lower protection layer has a binder including a polymer whose I/O value is equal to or less than 0.60, and a ratio of the I/O value of the polymer binder of the lower protection layer to the I/O value of the polymer binder of a protection layer not adjacent to the image forming layer (upper protection layer) is less than 1.0. In such a heat developable image recording material, though a polymer latex or latexes are used as a binder for image forming layer to cope with both of good photographic characteristics and water-based coating, adherence between the image forming layer and the protection layer is maintained good even after heat development, as well as occurrences of "white powders" can be prevented, under the protection layer structure as described above. To the contrary, if the protection layer is a single layer, the material cannot offer effects of the improved adherence and prevention of white powder occurrences even where the I/O value of the polymer binder is ranged. On the other hand, if the ratio of the I/O value is 1.0 or greater, white powders may occur, and if the I/O value of the lower protection layer exceeds 0.60, adherence is weakened. It is to be noted that the I/O value is described below.

It is preferable to use a polymer latex as a binder of the image forming layer and the protection layer.

The polymer latex used in the image forming layer of the invention is preferably at 50% or greater by weight with respect to all of the binder. The polymer latex used in the protection layer of the invention is preferably at 80% or greater by weight with respect to all of the binder. Hereinafter, the polymer latex used in this binder is referred to as "polymer latex of the invention." The polymer latex can be used not only for the image forming layer and the protection layer but also for the back layer. Particularly, when the heat developable image recording material of the invention is used for the printing purpose in which size deviation is concerned, it is preferable to use the polymer latex in the back layer. However, "the polymer latex" herein indicates a water-insoluble hydrophobic polymer as fine particles dispersed in a water-soluble dispersion medium. With respect to the dispersion state, the polymer may be emulsified in the dispersion medium, emulsion-polymerized or micell dispersed or the polymer may have a partially hydrophilic structure in the polymer molecule so that the molecular chain itself is dispersed in the molecule. The polymer latex in the present invention is described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keishi Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably on the order of from 5 to 1,000 nm. The particle size distribution of the dispersed particles is not particularly limited, and the dispersed particles may have a broad particle size distribution or a mono-disperse particle size distribution.

As the polymer latex used for the present invention, a so-called core and shell type latex may be used other than the normal polymer latex having a uniform structure. In this case, it is preferred in some cases that the core and the shell have different glass transition temperatures.

The polymer latex used as the binder in the present invention has a glass transition temperature (Tg) of which preferred range may be different among those for the protection layer, the back layer and the image forming layer. In the image forming layer, the glass transition temperature is preferably 40 or less, more preferably from −30° C. to 40° C., to promote diffusions of the photographically useful materials during the heat development. In the protection layer and the back layer, the glass transition temperature is preferably 25° C. to 100° C. because the protection layer (especially the outmost layer) and the back layer (especially the outmost layer) are brought into contact with various instruments.

The Tg of the polymer can be obtained in a way as described in, e.g., "Polymer Handbook, 2$^{nd}$ Edition III-139 to III-192(1975), J. Brandrup, E. H. Immergut, as co-authors.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer and it is an organic compound (usually an organic solvent) capable of reducing the minimum film-forming temperature of the polymer latex. This organic compound is described in Souichi Muroi, Gosei Latex no Kagaku (Chemistry of Synthetic Latex), Kobunshi Kanko Kai (1970), ibid.

The followings are specific compound examples of such plasticizers, but this invention is not limited to the compounds below.

| | |
|---|---|
| K-1 | Benzyl alcohol |
| K-2 | 2-dimethylaminoethanol |
| K-3 | 2,2,4-trimethylpentanediol 1,3-monoisobutylate |
| K-4 | diacetone alcohol |
| K-5 | ethylene glycol monobutylether |
| K-6 | diethylene glycol monobutylether acetate |
| K-7 | dibutyl phthalate |
| K-8 | diethylene glycol |

Particularly, it is preferable to add a plasticizer when the protection layer is formed. The adding amount is preferably, 1 to 30% by weight, more preferably, 5 to 20% by weight, with respect to the solid portion of the polymer latex in the coating liquid for protection layer.

In a case of the image forming layer, it is preferable to set 1 to 30% by weight with respect to the solid portion of the polymer latex of the coating liquid.

The polymer species of the polymer latex for use in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a number average molecular weight of from 5,000 to 1,000,000, more preferably on the order of from 10,000 to 100,000. If the molecular weight is too small, the image-forming layer is deficient in the mechanical strength, whereas if it is excessively large, the film forming property is disadvantageously poor.

Specific examples of the polymer latex used as a binder in the image forming layer of the heat developable image recording material of the present invention include a methyl methacrylate/ethyl acrylate/methacrylic acid copolymer latex, methyl methacrylate/2-ethylhexyl acrylate/hydroxyethyl methacrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex and vinylidene chloride/ethyl acrylate/acrylonitrile/methacrylic acid copolymer latex. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 820, 857, 857 (all produced by Nippon Zeon Co., Ltd); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C, 2507 (all produced by Nippon Zeon Co., Ltd.); vinyl chloride resins such as G351, G576 (both produced by Nippon Zeon Co., Ltd.); vinylidene chloride resins such as L502, L513 (both produced by Asahi Chemical Industry Co., Ltd.), ARON D7020, D504, D5071 (all produced by Mitsui Petrochemical Industries, Ltd.); and olefin resins such as CHEMIPEARL S120 and SA100 (both produced by Mitsui Petrochemical Industries, Ltd.) and the like. These polymers may be used individually or if desired, as a blend of two or more thereof.

The protection layer of the invention is made of two or more layers. A polymer of the protection layer adjacent to the image forming layer has an I/O value equal to or less than 0.60, preferably from 0.55 to 0.10, and concurrently, a ratio of the I/O value of the polymer binder of the protection layer adjacent to the image forming layer (lower protection layer) to the I/O value of the polymer binder of the protection layer not adjacent to the image forming layer (upper protection layer) formed thereon is less than 1.0, preferably, from 0.98 to 0.4. The upper protection layer, for the purpose of seeking the I/O value, is an upper layer adjacent to the lower protection layer since normally the protection layers of a two-layer structure are frequently used, but if the protection layer is made of three or more layers, the upper protection layer may be not adjacent to the lower protection layer. The polymer binder of the protection layer indicates a main binder, which occupies 80% by weight or greater with respect to the entire binders. If the main binder is constituted by mixing two or more types of such polymer binders, it is necessary for all polymer binders to satisfy the above relationships.

The I/O value of a polymer used as a binder for protection layer according to the present invention, namely a value of an inorganic value divided by an organic value based on an organic conception diagram, can be sought by a method as described in "Yuuki Gainen Zu—Kiso To Ohyoh—(Organic Concept Diagram—Fundamentals and Applications—) Yoshio Kohda, Sankyo Shuppan (1984).

Here, the organic concept diagram is to indicate entire organic compounds at each position on the orthogonal coordinate whose axes indicate, respectively, the organic axis and the inorganic axis, where the characteristics of the compounds are categorized into an organic value representing a covalent bond tendency and an inorganic value representing an ionic bond tendency. The inorganic value based on this diagram is determined with respect to inorganic property, or the greatness of affecting force to the boiling point of various substituents on a basis of hydroxyl group, and is a value in which an affecting force per hydroxyl group is defined as 100 in numeral, since it is about 100° C. if a distance between the boiling curve of a straight chain alcohol and the boiling curve of a straight chain paraffin is taken around carbon number five. In a meantime, the organic value is determined based on that the greatness of the number of the organic value can be measured by the number of carbon atoms representing the methylene groups where each methylene group in the molecule is treated as a unit. The organic value is set with a standard in which a single piece number of the carbon number as the basis is determined as twenty from the average boiling point increase of 20° C. caused by one carbon atom addition to the straight chain compound having a carbon number around 5 to 10. The inorganic value and the organic value are set to correspond one to one on the graph. The I/O value is calculated from those values.

As binders for the protection layer of the invention, among these polymer latexes, preferably used are those of acryl based, styrene based, acryl/styrene based, vinyl chloride based, and vinylidene chloride based.

The followings are specific compound examples, and the invention is not limited to the following compounds (composite ratio is of % by weight, NW denotes the average molecular weight).

P-1 methyl methacrylate/2-ethylhexyl acrylate/styrene/hydroxyethyl methacrylate/acrylic acid=58/26/9/5/2 (MW=100,000)

P-2 methyl methacrylate/2-ethylhexyl acrylate/styrene/hydroxyethyl methacrylate/methacrylic acid=59/26/9/5/1 (MW=90,000)

P-3 methyl methacrylate/2-ethylhexyl acrylate/hydroxyethyl methacrylate/acrylic acid=59/34/5/2 (MW=90,000)

P-4 styrene/butyl acrylate=64/36 (MW=100,000)

P-5 dodecyl acrylate/t-butyl methacylate=75/25 (MW=80,000)

P-6 2-ethylhexyl acrylate/methyl methacrylate=70/30 (MW=90,000)

P-7 butyl methacrylate/t-butyl methacrylate/methacrylate=40/10/50 (MW=90,000)

P-8 methacrylate/t-butyl methacrylate=85/15 (MW=90,000)

P-9 methacrylate/hydroxyethyl acrylate=90/10 (MW=80,000)

P-10 methacrylate/acrylic acid=80/20 (MW=100,000)

P-11 methyl methacrylate/2-ethylhexyl acrylate=72/28 (MW=90,000)

P-12 methyl methacrylate/butyl acrylate=73/27 (MW=90,000)

P-13 methyl methacrylate/ethyl acrylate=63/37 (MW=90,000)

P-14 methyl methacrylate/methyl acrylate=43/57 (MW=90,000)

P-15 styrene=100 (MW=90,000)

As a hydrophilic polymer for dispersion stabilizer contained in the image forming layer and the protection layer of the present invention, preferably used are such as polyvinyl alcohol, methyl cellulose, hydroxypropyl cellulose, carboxymethyl cellulose and hydroxypropylmethyl cellulose.

The followings are examples of hydrophilic polymers serving as a dispersion stabilizer used in the image forming layer and the protection layer of the present invention, but this invention is not limited to the following compounds.

P-1

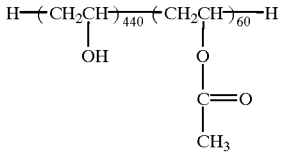

-continued

P-2

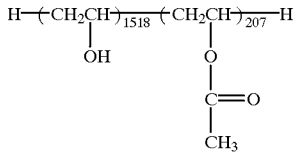

P-3

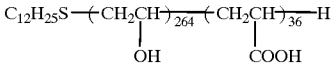

P-4

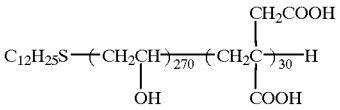

P-5

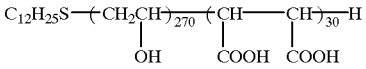

P-6

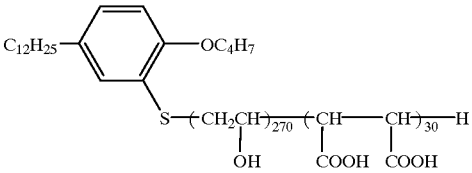

The adding amount of those hydrophilic polymers is preferably 30% by weight or less with respect to the entire binder or binders of the image forming layer, more preferably 10% by weight or less. There is no special lower limit in this situation but it is about 1% by weight. The adding amount of those hydrophilic polymers is preferably 3% by weight or less with respect to the entire binder or binders of the protection layer, more preferably 1% by weight or less. There is no special lower limit in this situation but it is about 0.1% by weight.

Known anionic surfactants can be used for surfactants of the dispersion stabilizer contained in the image forming layer and the protection layer of the invention.

The followings are specific examples of surfactants serving as a dispersion stabilizer used in the image forming layer and the protection layer of the invention, but this invention is not limited to the following compounds.

W-1

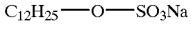

W-2

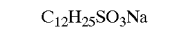

W-3

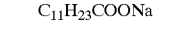

W-4

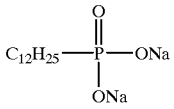

W-5

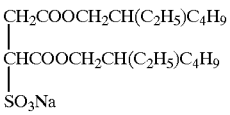

-continued

W-6

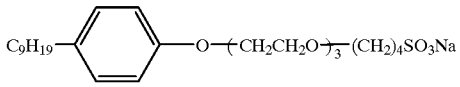

W-7

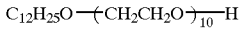

W-8

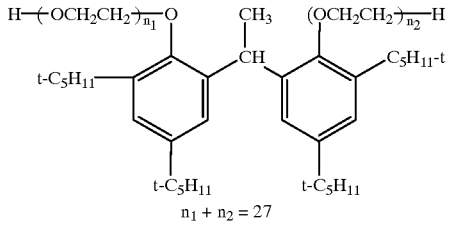

W-9

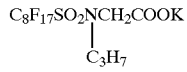

The adding amount of those surfactants is preferably 5% by weight or less with respect to the entire binder or binders of the image forming layer and the protection layer, more preferably 2% by weight or less. There is no special lower limit in this situation but it is about 0.1% by weight.

Although water makes 70% by weight or greater (but 100% by weight or less) of the solvent (disperse medium) of the image forming layer coating liquid of the invention and 80% by weight or greater (but 100% by weight or less) of the solvent (disperse medium) of the protection layer coating liquid of the invention, components other than water of the coating solution may be a water-miscible organic solvent such as methyl alcohol, ethyl alcohol, isopropyl alcohol, methyl cellusolve, ethyl cellusolve, dimethylformamide, and ethyl acetate. As examples of a detailed solvent composition, other than water, the followings can be exemplified: water/methanol=90/10, water/methanol=70/30, water/ethanol=90/10, water/isopropanol=90/10, water/dimethylformamide=95/5, water/methanol/dimethylformamide=80/15/5, water/methanol/dimethylformamide=90/5/5 (the number indicates percent by weight).

The total binder amount of the image forming layer of the invention is 0.2 to 30 g/m$^2$, more preferably 1 to 15 m$^2$. A crosslinking agent for crosslinking and a surfactant for improving coating capability or the like can be added to the image forming layer of the invention.

The entire binder amount (per one layer) of the protection layer of the invention is in a range of 0.2 to 10 g/m$^2$, more preferably 1 to 5 g/m$^2$. A surfactant or the like can be added to the protection layer of the invention to improve the coating property. The ph of the protection layer coating liquid is preferably, 5 to 8 for the lower layer and 2 to 7 for the upper layer.

The back layer and the undercoat layer on at least either side of the support of the heat developable image recording material of the present invention, or preferably adjacent to the support, preferably contain metal oxides in order to reduce dust adhesion, and it is preferred that at least one of the back layer and the undercoat layer (those provided on the double sides of the support) should be an electroconductive layer.

As the metal oxide used for this, those disclosed in JP-A-61-20033 and JP-A-56-82504 are particularly preferred.

According to the present invention, the amount of the electroconductive metal oxide is preferably 0.05 to 20 g, particularly preferably 0.1 to 10 g per 1 $m^2$ of the image recording material. Surface resistivity of the metal oxide-containing layer is not more than $10^{12}$ ω, preferably not more than $10^{11}$ ω under an atmosphere of 25° C. and 25% RH. Such surface resistivity affords good antistatic property. The lower limit of the surface resistivity is not particularly limited, but it is generally around $10^7$ ω.

According to the present invention, further improved antistatic property can be obtained by using a fluorine containing surfactant in addition to the aforementioned metal oxide.

The preferred fluorine-containing surfactants for use in the invention are surfactants which have a fluoroalkyl, fluoroalkenyl or fluoroaryl group which has at least 4 carbon atoms (usually 15 or less), and which have, as ionic groups, anionic groups (for example, sulfonic acid or salts thereof, sulfuric acid or salts thereof, carboxylic acid or salts thereof, phosphoric acid or salts thereof), cationic groups (for example, amine salts, ammonium salts, aromatic amine salts, sulfonium salts, phosphonium salts), betaine groups (for example, carboxyamine salts, carboxyammonium salts, sulfoamine salts, sulfoammonium salts, phosphoammonium salts), or non-ionic groups (substituted or unsubstituted poly(oxyalkylene) groups, polyglyceryl groups or sorbitane residual groups).

Such fluorine-containing surfactants have been disclosed, for example, in JP-A-49-10722, British Patent 1,330,356, U.S. Pat. Nos. 4,335,201 and 4,347,308, British Patent 1,417,915, JP-A-55-149938, JP-A-58-196544 and British Patent No. 1,439,402. Specific examples of these materials are indicated below.

F-1

$$C_8F_{17}SO_3K$$

F-2

$$C_8F_{17}SO_2N(C_3H_7)-CH_2COOK$$

F-3

$$C_8F_{17}SO_2N(C_4H_9)-(CH_2CH_2O)_4(CH_2)_4SO_3Na$$

F-4

$$C_8F_{17}SO_2N(H)CH_2CH_2CH_2OCH_2CH_2-\overset{\oplus}{N}(CH_3)_2-CH_3\ \ CH_3-C_6H_4-SO_3^{\ominus}$$

F-5

$$C_8F_{17}SO_3Li$$

No limitation is imposed upon the layer to which the fluorine-containing surfactant is added provided that it is included in at least one layer of the image recording material, and it can be included, for example, in the surface protecting layer, emulsion layer, intermediate layer, undercoat layer or back layer. It is, however, preferably added to the surface protective layer, and while it may be added to one of the protective layers on the image-forming layer side and the back layer side, it is further preferably added to at least the protective layer on the image-forming layer side.

When the surface protective layer is composed of two or more layers, the fluorine-containing surfactant can be added to any of these layers, or it may be used in the form of an overcoat over the surface protective layer.

The amount of fluorine-containing surfactant used in this invention may be from 0.0001 to 1 g, preferably from 0.0002 to 0.25 g, particularly desirably from 0.0003 to 0.1 g, per 1 $m^2$ of the image recording material.

Furthermore, two or more of the fluorine-containing surfactants can be mixed together.

Undercoat layers containing a vinylidene chloride copolymer are preferably provided on double sides of the support of the present invention. The vinylidene chloride copolymer for this contains 70% by weight or more of vinylidene chloride monomer repeating units (also referred to as "vinylidene chloride monomers" hereinafter). When the vinylidene chloride monomer content is less than 70% by weight, sufficient moisture barrier property cannot be obtained, and hence the dimensional change over time after the heat development becomes large. The vinylidene chloride copolymer preferably contains carboxyl group-containing vinyl monomer repeating units (also referred to as "carboxyl group-containing vinyl monomers") as repeating units other than the vinylidene chloride monomers. Such structural repeating units are contained because the vinyl chloride monomers alone afford crystallization of the polymer, which makes it difficult to form a uniform film when the moisture barrier layer is coated, and the carboxyl group-containing vinyl monomers are indispensable for stabilization of the polymer.

The vinylidene chloride copolymer of the present invention is a copolymer preferably containing 70–99.9% by weight, more preferably 85–99% by weight of vinylidene chloride monomers and preferably 0.1–5% by weight, more preferably 0.2–3% by weight of carboxyl group-containing vinyl monomers.

The carboxyl group-containing vinyl monomer used for the vinylidene chloride copolymer of the present invention is a vinyl monomer having one or more carboxyl groups in a molecule, and specific examples thereof include, for example, acrylic acid, methacrylic acid, itaconic acid, citraconic acid and the like.

The vinylidene chloride copolymer of the present invention may contain repeating units of monomers other than the vinylidene chloride monomer and the carboxyl group-containing monomer, which are copolymerizable with these monomers.

Examples of such monomers include, for example, acrylonitrile, methacrylonitrile, methyl acrylate, ethyl acrylate, methyl methacrylate, glycidyl methacrylate, 2-hydroxyethyl methacrylate, vinyl acetate, acrylamide, styrene, and the like.

These monomers can be used individually, or in any combination of two or more of them.

The molecular weight of the vinylidene chloride copolymer of the present invention is preferably 45000 or less, more preferably 10000 to 45000 in terms of weight average molecular weight. When the molecular weight becomes too large, adherence between the vinylidene chloride copolymer layer and the support layer of polyester or the like is degraded.

The vinylidene chloride copolymer of the present invention may be used by dissolving it in an organic solvent, or as an aqueous dispersion of latex. However, the aqueous dispersion of latex is preferred.

In the latter case, the latex may have polymer particles in a uniform structure, or in a so-called core/shell structure comprising a core and a shell with different compositions.

The particle size or the like of the polymer particles in the latex may be similar to those used for the binder of the image forming layer or the protection layer.

The sequence of the monomeric units of the vinylidene chloride copolymer is not particularly limited, and it may show periodicity or randomness, or may be composed of blocks.

The following can be mentioned as specific examples of the vinylidene chloride copolymer of the present invention. The parenthesized numerals indicate weight ratios. The average molecular weights represent weight average molecular weights.

V-1: latex of vinylidene chloride/methyl acrylate/acrylic acid (90:9:1, average molecular weight of 42000);

V-2: latex of vinylidene chloride/methyl acrylate/methyl methacrylate/acrylonitrile/methacrylic acid (87:4:4:4:1, average molecular weight of 40000);

V-3: latex of vinylidene chloride/methyl methacrylate/glycidyl methacrylate/methacrylic acid (90:6:2:2, average molecular weight of 38000);

V-4: latex of vinylidene chloride/ethyl methacrylate/2-hydroxyethyl methacrylate/acrylic acid (90:8:1.5:0.5, average molecular weight of 44000);

V-5: core shell type latex (90% by weight of core and 10% by weight of shell);

Core: vinylidene chloride/methyl acrylate/methyl methacrylate/acrylonitrile/acrylic acid (93:3:3:0.9:0.1);

Shell: vinylidene chloride/methyl acrylate/methyl methacrylate/acrylonitrile/acrylic acid (88:3:3:3:3), (average molecular weight of 38000).

V-6: core shell type latex (70% by weight of core and 30% by weight of shell)

Core: vinylidene chloride/methyl acrylate/methyl methacrylate/acrylonitrile/methacrylic acid (92.5:3:3:1:0.5);

Shell: vinylidene chloride/methyl acrylate/methyl methacrylate/acrylonitrile/methacrylic acid (90:3:3:1:3), (average molecular weight of 20000).

The vinylidene chloride copolymers may be used individually, or in any combination of two or more of them.

The vinylidene chloride copolymer of the present invention is used in such an amount that the undercoat layer containing the vinylidene chloride copolymer should have a total thickness for one side of 0.3 $\mu$m or more, preferably 0.3 to 4 $\mu$m.

The vinylidene chloride copolymer layer serving as the undercoat layer is preferably provided as the first undercoat layer that is directly coated on the support. While one undercoat layer is usually provided for each side, two or more layers may be provided as the case may be. When a multiple-layer structure composed of two or more layers is used, the vinylidene chloride copolymer amount range defined by the present invention may be satisfied by the total amount of the vinylidene chloride copolymers in such layers.

Because the vinylidene chloride copolymer layer usually is made of a monolayer structure as mentioned above, the thickness is preferably 0.3 to 4 $\mu$m, more preferably 0.6 to 3 $\mu$m, particularly preferably 1.0 to 2 $\mu$m in order to obtain a good applied surface condition.

This layer may contain, other than the vinylidene chloride copolymer, a crosslinking agent, a matting agent and the like.

For the heat developable image recording material of the present invention, various kinds of support can be used. Typical supports comprise polyester such as polyethylene terephthalate, and polyethylene naphthalate, cellulose nitrate, cellulose ester, polyvinylacetal, polycarbonate or the like. Among these, biaxially stretched polyester, especially polyethylene terephthalate (PET), is preferred in view of strength, dimensional stability, chemical resistance and the like. The support preferably has a thickness of 90 to 180 $\mu$m as a base thickness excluding the undercoat layer.

Preferably used as the support of the heat developable image recording material of the present invention is a polyester film, in particular polyethylene terephthalate film, subjected to a heat treatment in a temperature range of 130 to 185° C. in order to relax the internal distortion formed in the film during the biaxial stretching so that thermal shrinkage distortion occurring during the heat development should be eliminated. Such a thermal relaxation treatment may be performed at a constant temperature within the above temperature range, or it may be performed with raising the temperature.

The heat treatment of the support may be performed for the support in the form of a roll, or it may be performed for the support that is conveyed as a web. When it is performed for a support that is conveyed as a web, it is preferred that the conveying tension should be not more than 7 kg/cm$^2$, in particular, not more than 4.2 kg/cm$^2$. The lower limit of the conveying tension is, while not particularly limited, 0.5 kg/cm$^2$ or so.

This heat treatment is preferably performed after a treatment for improving adhesion of the image forming layer and the back layer to the support, application of the undercoat layer and the like.

The thermal shrinkage of the support upon heating at 120° C. for 30 seconds is preferably −0.03% to +0.01% for the machine direction (MD), and 0 to 0.04% for the transverse direction (TD).

The support may be applied with, other than the vinylidene chloride layer, an undercoat layer containing SBR, polyester, gelatin or the like as a binder, as required. The undercoat layer may be composed of multiple layers, and may be provided on a single side or double sides of the support. At least one of the undercoat layers may be an electroconductive layer. The undercoat layer generally has a thickness of 0.01 to 5 $\mu$m, more preferably 0.05 to 1 $\mu$m (for one layer). When it is an electroconductive layer, it preferably has a thickness of 0.01 to 1 $\mu$m, more preferably 0.03 to 0.8 $\mu$m.

For the image forming layer of the invention and the protection layer of the image forming layer, a light absorbing substance or a filter dye as described in U.S. Pat. No. 3,253,921, U.S. Pat. No. 2,274,782, U.S. Pat. No. 2,527,583, and U.S. Pat. No. 2,956,879 can be used. Moreover, the dye can be mordanted as described in U.S. Pat. No. 3,282,699. As the use amount of the filter dye, the light absorbing degree at the exposing wavelength is preferably 0.1 to 3, more preferably, 0.2 to 1.5.

The photosensitive layer that is the image forming layer for use in the present invention may contain a dye or pigment of various types so as to improve the color tone or prevent the irradiation. Any dye or pigment may be used in the photosensitive layer for use in the present invention, and examples thereof include pigments and dyes described in the color index. Specific examples thereof include organic pigments and inorganic pigments such as a pyrazoloazole dye, an anthraquinone dye, an azo dye, an azomethine dye, an oxonol dye, a carbocyanine dye, a styryl dye, a triphenylmethane dye, an indoaniline dye, an indophenol dye and phthalocyanine. Preferred examples of the dye for use in the present invention include anthraquinone dyes (e.g., Compounds 1 to 9 described in JP-A-5-341441, Compounds 3-6 to 3-18 and 3-23 to 3-38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). The dye may be added in any form of a solution, emulsified product or solid microparticle dispersion or may be added in the state mordanted with a polymer mordant, but if the substance is water-soluble, it is preferred to add the substance with a water solution and if the substance is not water soluble, it is preferred to add the substance in a form of solid microparticle dispersion where water is used as a disperse medium. The use amount of such a compound may be determined according to the objective amount absorbed but, in general, the compound is preferably used in an amount of from $1\times10^{-6}$ to 1 g per square meter of the heat developable image recording material.

The organic silver salt which can be used in the present invention is a silver salt which is relatively stable against light but forms a silver image when it is heated at 80° C. or higher in the presence of an exposed photocatalyst (e.g., a latent image of light-sensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, of which ligand has a complex stability constant of from 4.0 to 10.0, is also preferred. The silver-supplying substance may constitute preferably from about 5 to 70% by weight of the image-forming layer. The preferred organic silver salt includes a silver salt of an organic compound having a carboxyl group. Examples thereof include an aliphatic carboxylic acid silver salt and an aromatic carboxylic acid silver salt. However, the present invention is by no means limited thereto. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

Silver salts of compounds having a mercapto or thione group and derivatives thereof may also be used as the organic silver salt. Preferred examples of these compounds include a silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as silver salt of dithioacetic acid, silver salts of thioamides, silver salt of 5-carboxyl-1-methyl-2-phenyl-4-thiopyridine, silver salts of mercaptotriazines, silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited but an acicular crystal form having a short axis and a long axis is preferred. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined by the image of an organic silver salt dispersion observed through a transmission type electron microscope. Another method for determining the monodispesibility is a method involving obtaining the standard deviation of a volume load average diameter of the organic silver salt. The percentage (coefficient of variation) of the value obtained by dividing the standard deviation by the volume load average diameter is preferably 100% or less, more preferably 80% or less, still more preferably 50% or less. The grain size (volume load average diameter) for determining the monodispersibility may be obtained, for example, by irradiating a laser ray on an organic silver salt dispersed in a solution and determining an autocorrelation function of the fluctuation of the scattered light to the change in time.

The organic acid silver used in this invention is preferably prepared under existence of a tertiary alcohol. As a tertiary alcohol, it is preferable to use an alcohol having a total carbon number of 15 or less, more preferably 10 or less. As an example of a preferable tertiary alcohol, tert-butanol and the like are exemplified, but this invention is not limited to those.

Although the timing of addition of the tertiary alcohol used in this invention can be any timing during the preparation of the organic acid silver, it is preferable to solve and use the organic acid alkali metal salt upon addition of the alcohol during the preparation of the organic acid alkali metal salt. The use amount of the tertiary alcohol of the invention can be any amount in range of 0.01 to 10 by weight ratio to $H_2O$ as a solvent during the preparation of the organic acid silver, but the range of 0.03 to 1 is preferable.

The organic silver salt usable in this invention is preferably subject to desalting. There is no special limitation to methods for desalting, and known methods can be used. It is preferable to use known filtering methods such as centrifugal filtering, absorbing filtering, ultrafiltration, frock forming washing by cohesion method, and so on.

For obtaining a solid dispersed material of organic silver salt with a high S/N ratio and a smaller particle size and without cohesion, a dispersion method is preferably used in which a pressure is decreased after a water dispersion liquid including an organic silver salt serving as image forming media and substantially excluding photosensitive silver salt is converted into a high speed flow.

A photosensitive image forming medium coating liquid is preferably manufactured in mixing the photosensitive silver salt solution after such a process. If a heat developable image recording material is produced using such a coating liquid, a heat developable image recording material can be obtained with low haze, low fog and high sensitivity. To the contrary, if the flow is converted to high pressure, high speed flow, and if the photosensitive silver coexists during the dispersion, the fog increases and the sensitivity is lowered so much. If an organic solvent, instead of water, is used for a dispersing medium, the haze becomes so high, and the fog increases, while the sensitivity is likely lowered. On the other hand, if a conversion method in which a part of the organic silver salt in the dispersing liquid is converted into a photosensitive silver salt is used, the sensitivity is readily reduced.

The water dispersing liquid dispersed upon conversion to high pressure and high speed flow substantially excludes a photosensitive sliver salt, and the moisture amount is 0.1 mol % or less with respect to the non-photosensitive type organic silver salt, and the photosensitive silver salt is not positively added.

A solid dispersion apparatus and its technology used for implementing the above dispersing methods are described in detail in, e.g., "Bunsankei Rheology to Bunsankagijyutu (Disperse System Rheology and Dispersing Technology)", Toshio Kajiuchi, Hiroki Usui, 1991 Shinzannsya Shuppan (K.K.) p357 to p403, and "Kagaku Kogyou no Sinpo, Dai 24 shyu (Progress of Chemical Engineering, Vol. 24), Shyadan Houjinn, Kagakukougyoukai Tokai shibu, 1990, Maki Shoten, p184 to p185. The dispersing method in this invention is a method in which, after a water dispersion material at least including an organic silver salt is sent in a pipe upon pressurized by means of, e.g., a high pressure pump, the material is made to pass through fine slits formed in the pipe, and subsequently the dispersion liquid is rapidly subject to a reduced pressure thereby forming fine dispersions.

With respect to a high pressure homogenizer relating to this invention, it is generally thought that dispersion to fine particles occurs by, e.g., "shearing force" occurring at a time when the dispersoid passes through narrow intervals with high pressure and high speed, and "cavitation force" occurring when the dispersoid is released from the high pressure to the normal pressure. A Gorlin homogenizer can be exemplified as a dispersing apparatus of this type, and in this apparatus, a liquid to be dispersed under a high pressure is converted at narrow channels on a cylindrical surface to a high speed fluid, and collides to surrounding walls with that acceleration, thereby forming emulsion and dispersion by the impacting force. The pressure used is generally in a range of 100 to 600 kg/cm$^2$, and the fluid rate is in a range of several meters to 30 meters per second. To increase the dispersing effect, some are devised to have the high speed portion in a serriform to increase the number of collisions. Meanwhile, recently developed apparatuses are capable of dispersing with further higher pressure and higher flow velocity, and as a representative example, such as Microfluidizer (Microfluidics International Corporation), Nanomizer (Tokusyu Kika Kougyou (K.K.) can be exemplified.

As a dispersing apparatus suitable for this invention, Microfluidizer (Microfluidics International Corporation made), M-110S-EH [G10Z with interaction chamber], M-110Y [H10Z with interaction chamber], M-140K [G10Z with interaction chamber], HC-5000 (L30Z or H230Z with interaction chamber], HC-8000 [E230Z or L30Z with interaction chamber], and the like are exemplified.

A most suitable organic silver salt dispersed material for this invention can be obtained, using those apparatuses, by creating rapid reduction of pressure in the dispersion liquid by a method such that the pressure in the pipe is rapidly backed to the atmospheric pressure after applying a desired pressure to a water dispersion liquid including at least an organic silver salt by passing the liquid through fine slits formed in the pipe after the liquid is sent to the pipe with pressure from a high pressure pump or the like.

Before the dispersion manipulation, it is preferable to disperse the raw material liquid previously. As a means for pre-dispersion, known dispersing means (such as a high speed mixer, homogenizer, high impact mill, banbury mixer, homo mixer, kneeder, bowl mill, vibration bowl mill, planet bowl mill, atwriter, sand mill, beads mill, colloid mill, jet mill, roller mill, tron mill, high speed stone mill) can be used. The liquid can be made with fine particles, in a way other than subjecting to the mechanical dispersion, by changing the pH under existence of dispersion promoters after rough dispersion is made in the solvent by a pH control. As a solvent for the rough dispersion, an organic solvent can be used, and normally, the organic solvent is removed after making the fluid with fine particles.

In the dispersion of the organic silver salt in the invention, the dispersion can be made with desired particle sizes by adjustments of the fluid speed, the differential pressures during pressure reduction, and the number of processings. From a standpoint to the photographic characteristics and the particle sizes, a preferable fluid speed is of 200 m/sec to 600 m/sec, and the differential pressure during the reduction of the pressure is preferably in range of 900 to 3,000 kg/cm$^2$. More preferably, the fluid speed is of 300 m/sec to 600 m/sec, and the differential pressure during the reduction of the pressure is preferably in range of 1,500 to 3,000 kg/cm$^2$. The processing number of dispersions can be selected according the necessity, and in a normal case, the processing number of one to ten times is selected, and from a standpoint of productivity, the processing number of one to three times is selected. Making the water dispersion liquid at a high temperature under a high pressure is not favorable in terms of dispersion property and photographic characteristics, and if the temperature is high as to exceed 90° C., the particle size may be larger, and fog may increase. Accordingly, in this invention, a cooling process may be contained in either or both of a process before conversion to the high speed flow and a process after the pressure is reduce, and it is preferable to keep the temperature of such a water dispersion in a range of 5 to 90° C. by such a cooling process, more preferably, in range of 5 to 80° C., and further 5 to 60° C. Furthermore, it is effective to set the cooling process as described above for high pressure dispersion in a range of 1500 to 3000 kg/cm$^2$. The cooling apparatus can be selected from a double pipe, one using a static mixer for a double pipe, a multiple pipe type heat converter, a jig-sag pipe type heat converter, and the like. To increase the efficiency of the heat conversion, diameter, thickness, and material of the pipe are selected to be suitable in consideration of the used pressure. The coolant used in the cooling apparatus can be, in consideration of the heat conversion amount, a well water of 20° C. or a cool water of 5 to 10° C. processed in a refrigerator, or a coolant of ethylene glycol and water of −30° C. when necessary.

In a dispersion manipulation of the invention, it is preferable to disperse the organic silver salt under existence of a dispersant (dispersion promoter) soluble in an aqueous solvent. As a dispersion promoter, for example, synthetic anion polymers such as polyacrylic acid, acrylic acid copolymer, maleic acid monoester copolymer, and acryromethyl propanesulfonic acid copolymer, semi-synthetic anion polymers such as carboxylmethyl starch, and carboxylmethyl cellulose, anionic polymers such as alginic acid, and pectic acid, a compound as set forth in JP-A-7-350,753, known polymers such as anionic, nonionic, or cationic surfactants, and polyvinylalcohol, polyvinylpyrrolidone, carboxymethylcellulose, hydroxymethylcellulose, and hydroxypropylmethylcellulose, and a polymer compound existing naturally such as gelatin or the like can be used, and furthermore, polyvinylalcohol groups, and water-soluble cellulose derivatives can be used more preferably.

The dispersion promoter is made ordinarily by being mixed with powders of the organic silver salt or a wet cake state organic silver salt to be sent to a dispersing machine as a slurry, but can be mixed with the powers of the organic silver salt or a wet cake state organic silver salt upon processing of a thermal treatment or solvent treatment where mixed with the organic silver salt in advance. It can be subject to a pH control with a proper pH adjusting agent before or after or during dispersion.

In addition to the mechanical dispersion, the dispersion promoter can be dispersed roughly upon the pH control, and then, fine particles can be formed upon changing the pH under existence of the dispersion promoter. At that time, as a solvent used for the rough dispersion, an organic solvent can be used, and ordinarily, such an organic solvent is removed after making fine particles.

The prepared dispersed materials may be preserved while being stirred to suppress precipitation of fine particles during preservation or preserved at a high viscosity state (for example, gelatin is used in a jelly state) by means of hydrophilic colloids. An antiseptics may be added to prevent bacteria or the like from prospering.

The particle size (volume weighted mean diameter) of the solid fine particle dispersing material of the organic silver salt of the invention can be sought from, e.g., obtained particle sizes (volume weighted mean diameter) through a self-correlation function with respect to time change of fluctuation of a scattered light where a laser beam is radiated to the solid fine particle dispersing material dispersed in the liquid. The solid fine particle dispersing material desirably has a mean particle size of 0.05 micron or higher and 10.0 microns or lower, more preferably, a mean particle size of 0.1 micron or higher and 5.0 microns or lower, and further preferably, a mean particle size of 0.1 micron or higher and 2.0 microns or lower.

The particle size profile of the organic silver salt is preferable in a single dispersion. More specifically, the percentage (deviation coefficient) of a value that the standard deviation of the volume weighted mean diameter is divided by the volume weighted mean diameter is preferably, 80% or less, more preferably, 50% or less, and further preferably, 30% or less. As a measuring method of shapes of the organic silver salt, it can be sought by an image made with a transmission type electron microscope of an organic silver salt dispersion.

The solid fine particle dispersing material of the organic silver salt used in the invention includes at least the organic silver salt and water. There is no special limitation to the rate of the organic silver salt and the water, but the rate of the organic silver salt to the entirety is preferably 5 to 50% by weight, and more preferably, 10 to 30% by weight. It is preferable to use the dispersion promoter as described above. It is preferable to use it in a minimum amount in a range suitable for minimizing the particle size, and it is preferable to set it 1 to 30% by weight and particularly, in a range of 3 to 15% by weight.

With this invention, the image recording material can be manufactured by mixing the organic silver salt water dispersing liquid and the photosensitive sliver salt water dispersing liquid with each other. The mixing rate of the organic silver salt and the photosensitive silver can be selected depending on the purpose, and the rate of the organic silver salt to the photosensitive silver salt is preferably in a range of 1 to 30 mol %, more preferably, 3 to 20 mol %, and further preferably, 5 to 15 mol %. To mix two or more types of the organic silver salt water dispersing liquids and two or more types of the photosensitive sliver salt water dispersing liquids with each other is a suitable method used for adjusting the photographic property.

The organic silver salt of the invention can be used in a desired amount, and the suitable silver amount is 0.1 to 5 $g/m^2$, more preferably, 1 to 3 $g/m^2$.

The photosensitive silver halide is not limited as a halogen composition, and can be made of silver chloride, silver chlorobromide, silver bromide, silver iodobromide, and silver iodochlorobromide. The profile of the halogen composition in the particle can be uniform, changed stepwise in the halogen composition, or change continuously. Silver halide particles having a core or shell structure can be used preferably. As a structure, a structure of two to five layers is preferably used, and more preferably, core or shell particles of a structure of two to four layers is used. A technology in which silver bromide is located on surfaces of the particles of silver chloride or silver chlorobromide can be used preferably.

The method of forming photosensitive silver halide used for the present invention is well known in the art and, for example, the methods described in *Research Disclosure*, No. 17029 (June, 1978) and U.S. Pat. No. 3,700,458 may be used. Specifically, a method comprising converting a part of silver in the produced organic silver salt to photosensitive silver halide by adding a halogen-containing compound to the organic silver salt, or a method comprising adding a silver-supplying compound and a halogen-supplying compound to gelatin or other polymer solution to thereby prepare photosensitive silver halide and mixing the silver halide with an organic silver salt may be used for the present invention. The photosensitive silver halide particle preferably has a small particle size so as to prevent high white turbidity after the formation of an image. Specifically, the particle size is preferably 0.20 $\mu$m or less, more preferably from 0.01 to 0.15 $\mu$m, still more preferably from 0.02 to 0.12 $\mu$m. The term "particle size" as used herein means the length of an ridge of the silver halide particle in the case where the silver halide particle is a regular crystal such as cubic or octahedral particle; the diameter of a circle image having the same area as the projected area of the main surface plane in the case where the silver halide particle is a tabular silver halide particle; or the diameter of a sphere having the same volume as the silver halide particle in the case of other irregular crystals such as spherical or bar particle.

Examples of the shape of the silver halide particle include cubic form, octahedral form, tabular form, spherical form, stick form and bebble form, and among these, cubic particle and tabular particle are preferred in the present invention. When a tabular silver halide particle is used, the average aspect ratio is preferably from 100:1 to 2:1, more preferably from 50:1 to 3:1. A silver halide particle having rounded corners is also preferably used. The face index (Miller indices) of the outer surface plane of a photosensitive silver halide particle is not particularly limited; however, it is preferred that [100] faces capable of giving a high spectral sensitization efficiency upon adsorption of the spectral sensitizing dye occupy a high ratio. The ratio is preferably 50% or more, more preferably 65% or more, still more preferably 80% or more. The ratio of [100] faces according to the Miller indices can be determined by the method described in T. Tani, *J. Imaging Sci.*, 29, 165 (1985) using the adsorption dependency of [111] face and [100] face upon adsorption of the sensitizing dye.

The photosensitive silver halide particle for use in the present invention contains a metal or metal complex of Group VII or VIII ($7^{th}$ to $10^{th}$ Groups) in the Periodic Table. The center metals of the metal or metal complex of Group VII or VIII of the Periodic Table are preferably rhodium, rhenium, ruthenium, osnium or iridium. One kind of metal complex may be used or two or more kinds of complexes of the same metal or different metals may also be used in combination. The metal complex content is preferably from $1\times10^{-9}$ to $1\times10^{-2}$ mol, more preferably from $1\times10^{-8}$ to $1\times10^{-4}$ mol, per mol of silver. With respect to the specific structure of the metal complex, the metal complexes having the structures described in JP-A-7-225,449 may be used.

As the rhodium compound for use in the present invention, a water-soluble rhodium compound may be used. Examples thereof include a rhodium(III) halogenide compounds and rhodium complex salts having a halogen, an amine or an oxalate as a ligand, such as hexachlororhodium (III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. The rhodium compound is used after dissolving it in water or an appropriate solvent and a method commonly used for stabilizing the rhodium compound solution, that is, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble rhodium, separate silver halide particles previously doped with rhodium may be added and dissolved at the time of preparation of silver halide.

The amount of the rhodium compound added is preferably from $1\times10^{-8}$ to $5\times10^{-6}$ mol, more preferably from $5\times10^{-8}$ to $1\times10^{-6}$ mol, per mol of silver halide.

The rhodium compound may be appropriately added at the time of production of silver halide emulsion particles or at respective stages before coating of the emulsion. However, the rhodium compound is preferably added at the time of formation of the emulsion and integrated into the silver halide particle.

The rhenium, ruthenium or osmium for use in the present invention is added in the form of a water-soluble complex salt described in JP-A-63-2042, JP-A-1-285941, JP-A-2-20852 and JP-A-2-20855. A preferred example thereof is a six-coordinate complex salt represented by the following formula:

$$[ML_6]^{n-}$$

wherein M represents Ru, Re or Os, L represents a ligand, and n represents 0, 1, 2, 3 or 4. In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RUCl_6]^{3-}$ | $[RUCl_4(H_2O)_2]^{-}$ | $[RUCl_5(H_2O)]^{2-}$ |
| $[RUCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The addition amount of these compound is preferably from $1'10^{-9}$ to $1\times10^{-5}$ mol, more preferably from $1\times10^{-8}$ to $1\times10^{-6}$ mol, per mol of silver halide.

These compounds may be added appropriately at the time of preparation of silver halide emulsion particles or at respective stages before coating of the emulsion, but the compounds are preferably added at the time of formation of the emulsion and integrated into a silver halide particle.

For adding the compound during the particle formation of silver halide and integrating it into a silver halide particle, a method where a metal complex powder or an aqueous solution having dissolved therein the metal complex together with NaCl or KCl is added to a water-soluble salt or water-soluble halide solution during the particle formation, a method where the compound is added as the third solution at the time of simultaneously mixing a silver salt and a halide solution to prepare silver halide particles by the triple jet method, or a method where a necessary amount of an aqueous metal complex solution is poured into a reaction vessel during the particle formation, may be used. Among these, preferred is a method comprising adding a metal complex powder or an aqueous solution having dissolved therein the metal complex together with NaCl or KCl to a water-soluble halide solution.

In order to add the compound to the particle surface, a necessary amount of an aqueous metal complex solution may be charged into a reaction vessel immediately after the particle formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide particles previously doped with iridium may be added and dissolved at the time of preparation of silver halide.

The silver halide particle for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion. However, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount of from $1\times10^{-9}$ to $1\times10^{-4}$ mol per mol of silver halide. The metal may be converted into a metal salt in the form of a simple salt, a composite salt or a complex salt and added at the time of preparation of particles.

The photosensitive silver halide particle may be desalted by water washing according to a method known in the art, such as noodle washing and flocculation, but the particle may not be desalted in the present invention.

As a gold sensitizer used when the silver halide emulsion of the invention is subject to gold sensitization, gold compound used ordinarily as a gold sensitizer having an oxidation number of monovalent or trivalent can be used. As representative examples, chroloaurate , potassium chroloaurate, auricrichloride, potassium auricrictiocyanate, potassium iodoaurate, tetracyanoauric acid, ammonium aurotiocyanate, pyrdyltrichlorogold, and the like are exemplified.

The addition amount of the gold sensitizer may vary depending on each condition, and as a standard, it is $10^{-7}$ mol or higher and $10^{-3}$ mol or lower per one mol of the silver halide, and more preferably, it is $10^{-6}$ mol or higher and $5\times10^{-4}$ mol or lower.

It is preferable to use together the gold sensitization and other chemical sensitizations for the silver halide emulsion of the invention. As other chemical sensitizations, the chemical sensitization may be performed using a known method such as sulfur sensitization, selenium sensitization, tellurium sensitization or noble metal sensitization. These sensitization method may be used alone or in any combination. When these sensitization methods are used as a combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain. However, it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in Japanese Patent Publication [KOKOKU] (hereinafter referred simply to as "JP-B") 44-15748, JP-B-43-13489, Japanese Patent Application Nos. 2-13097, 2-229300 and 4-324855. Among these, particularly preferred are the compounds represented by formulae (VIII) and (IX) of JP-A-4-324855.

The tellurium sensitizer for use in the present invention is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, diacyl tellurides, bis(oxycarbonyl) ditellurides, bis(carbamoyl) ditellurides, compounds having a P=Te bond, tellurocarboxylates, Te-organyltellurocarboxylic acid esters, di(poly)tellurides, tellurides, tellurols, telluroacetals, tellurosulfonates, compounds having a P-Te bond, Te-containing heterocyclic rings, tellurocarbonyl compounds, inorganic tellurium compounds and colloidal tellurium. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, Japanese Patent Application Nos. 3-53693, 4-271341, 4-333043, and 5-303157, *J. Chem. Soc. Chem. Commun.*, 635 (1980), *ibid.*, 1102 (1979), *ibid.*, 645 (1979), *J. Chem. Soc. Perkin. Trans.*, 1, 2191 (1980), S. Patai (compiler), *The Chemistry of Organic Selenium and Tellurium Compounds*, Vol. 1 (1986), and *ibid.*, Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions. However, it is usually from $10^{-8}$ to $10^{-2}$ mol, preferably on the order of from $10^{-7}$ to $10^{-3}$ mol, per mol of silver halide. The conditions for chemical sensitization in the present invention are not particularly restricted. However, in general, the pH is from 5 to 8, the pAg is from 6 to 11, preferably from 7 to 10, and the temperature is from 40 to 95° C., preferably from 45 to 85° C.

In the silver halide emulsion for use in the present invention, a cadmium salt, sulfite, lead salt or thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. Also, the reduction sensitization may be performed by introducing a single addition part of silver ion during the formation of grains.

To the silver halide emulsion of the present invention, a thiosulfonic acid compound may be added by the method described in European Patent 293917A.

In the heat developable image-forming material of the present invention, one kind of silver halide emulsion may be used or two or more kinds of silver halide emulsions (for example, those different in the average grain size, different in the halogen composition, different in the crystal habit or different in the chemical sensitization conditions) may be used in combination.

The amount of the photosensitive silver halide used in the present invention is preferably from 0.01 to 0.5 mol, more preferably from 0.02 to 0.3 mol, still more preferably from 0.03 to 0.25 mol, per mol of the organic silver salt. The method and conditions for mixing photosensitive silver halide and organic silver salt which are prepared separately are not particularly limited as far as the effect of the present invention can be brought out satisfactorily. However, a method of mixing the silver halide grains and the organic silver salt after completion of respective preparations in a high-speed stirring machine, a ball mill, a sand mill, a colloid mill, a vibrating mill or a homogenizer or the like, or a method involving preparing organic silver salt while mixing therewith photosensitive silver halide after completion of the preparation in any timing during preparation of the organic silver salt, or the like may be used.

The heat developable image recording material of the present invention contains a reducing agent for organic silver salt. The reducing agent for organic silver salt may be any substance, preferably an organic substance, which reduces the silver ion to metal silver. Conventional photographic developers such as phenidone, hydroquinone and catechol are useful, but a hindered phenol reducing agent is preferred. The reducing agent is preferably contained in an amount of from 5 to 50% by mol, more preferably from 10 to 40% by mol, per mol of silver on the surface having an image-forming layer. The layer to which the reducing agent is added may be any layer on the surface having an image-forming layer. In the case of adding the reducing agent to a layer other than the image-forming layer, the reducing agent is preferably used in a slightly large amount of from 10 to 50% by mol per mol of silver. The reducing agent may also be a so-called precursor which is derived to effectively exhibit the function only at the time of development.

For the heat developable light-sensitive material using an organic silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent 692732 and the like. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2',4'-dihydroxybenzophenone, 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent of the present invention may be added in any form of a solution, powder and a solid microparticle dispersion. The solid microparticle dispersion is performed using a known pulverizing means (e.g., ball mill, vibrating ball mill, sand mill, colloid mill, jet mill, roller mill). At the time of solid microparticle dispersion, a dispersion aid may also be used.

When an additive known as a "color toner" capable of improving the image is added, the optical density increases in some cases. Also, the color toner is advantageous in forming a black silver image depending on the case. The color toner is preferably contained on the surface having an image-forming layer in an amount of from 0.1 to 50% by mol, more preferably from 0.5 to 20% by mol, per mol of silver. The color toner may be a so-called precursor which is derived to effectively exhibit the function only at the time of development.

For the heat developable light-sensitive material using an organic silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795 and Belgian Patent No. 841910. Examples of the color toner include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N'-(dimethylaminomethyl)naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (derivatives such as e.g., 4-(1-naphthyl)phthalazine, 6-chlorophthalazinone, 5,7-dimethoxyphthalazine, isopropylphthalazine, 6-iso-butylphthalazine, 6-tert-butylphthalazine, 5,7-dimethylphthalazine, and 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

The color toner of the present invention may be preferably added with a water solution, but in the case that the toner is water-insoluble, the toner can be added in any form of, e.g., a methanol solution, powders, solid microparticle dispersion and the like. The solid fine particle dispersion is performed using a known pulverization means (e.g., ball mill, vibrating ball mill, sand mill, colloid mill, jet mill, roller mill). At the time of solid microparticle dispersion, a dispersion aid may also be used.

Now, substituted alkene derivatives, substituted isooxazole derivatives, and specific acetal compounds, represented by Formula (1) to Formula (3) and used as nucleation agents in the present invention are described.

(1)

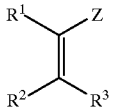

(2)

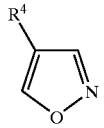

(3)

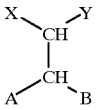

In Formula (1), $R^1$, $R^2$ and $R^3$ each independently represents a hydrogen atom or a substituent; Z represents an electron withdrawing group. In Formula (1), $R^1$ and Z, $R^2$ and $R^3$, $R^1$ and $R^2$, or $R^3$ and Z may be combined with each other to form a ring structure. In Formula (2), $R^4$ represents a substituent. In Formula (3), X and Y each independently represents a hydrogen atom or a substituent; A and B each independently represents an alkoxy group, an alkylthio group, an alkylamino group, an aryloxy group, an arylthio group, an anilino group, a heterocyclic oxy group, a heterocyclic thio group or a heterocyclic amino group. In Formula (3), X and Y, or A and B may be combined with each other to form a ring structure.

In Formula (1), $R^1$, $R^2$ and $R^3$ each independently represents a hydrogen atom or a substituent, and Z represents an electron withdrawing group or a silyl group. In Formula (1), $R^1$ and Z, $R^2$ and $R^3$, $R^1$ and $R^2$, or $R^3$ and Z may be combined with each other to form a ring structure.

When $R^1$, $R^2$ or $R^3$ represents a substituent, examples of the substituent include a halogen atom (e.g., fluorine, chlorine, bromide, iodine), an alkyl group (including, e.g., an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group or a salt thereof, an alkoxy group (including a group containing an ethyleneoxy group or propyleneoxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, an acylamino group, a sulfonamide group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group or a salt thereof, an (alkyl, aryl or heterocyclic)thio group, an acylthio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These substituents each may further be substituted by any of the above-described substituents.

The electron withdrawing group represented by Z in Formula (1) is a substituent having a Hammett's substituent constant op of a positive value, and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamide group, a sulfonamide group, an acyl group, a formyl group, a phosphoryl group, a carboxy group, a sulfo group (or a salt thereof), a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, an urazole-1-yl group, a succinimido group and a phthalimido group. The electron withdrawing group represented by Z in Formula (1) may have a further substituent or substituents.

The electron withdrawing group represented by Z in Formula (1) is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, a thiocarbonyl group, an imino group, an imino group substituted by N atom, a sulfamoyl group, an alkylsulfonyl group, an arylsulfonyl group, an acyl group, a formyl group, a phosphoryl group, a trifluoromethyl group or a phenyl group substituted by any electron withdrawing group, further more preferably a cyano group, an alkoxycarbonyl group, a carbamoyl group, an imino group, an imino group substituted by N atom, an alkylsulfonyl group, an arylsulfonyl group, an acyl group, a formyl group.

The substituent represented by $R^1$ in Formula (1) is preferably a group having a total carbon atom number of from 0 to 30 and specific examples of the group include a group having the same meaning as the electron withdrawing group represented by Z in Formula (1), an alkyl group, an alkenyl group, an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an acylamino group, a silyl group and a substituted or unsubstituted aryl group, more preferably, a group having the same meaning as the electron withdrawing group represented by Z in Formula (1), a substituted or unsubstituted aryl group, an alkenyl group, an alkylthio group, an arylthio group, an alkoxy group, a silyl group, and an acylamino group, further more preferably, the electron withdrawing group, an aryl group, an alkenyl group, and an acylamino group.

When $R^1$ represents the electron withdrawing group, a desirable range is the same as the desirable range of the electron withdrawing group represented by Z.

The substituent represented by $R^2$ or $R^3$ in Formula (1) is preferably a group having the same meaning as the electron withdrawing group represented by Z in above Formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group or a substituted or unsubstituted phenyl group. With the $R^2$ and $R^3$, either one is more preferably, a hydrogen atom and the other is a substituent. The substituent is preferably an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamide group), a sulfonamide group, a substituted or unsubstituted phenyl group or a heterocyclic group, more preferably a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, or a heterocyclic group, still more preferably a hydroxy group (or a salt thereof), an alkoxy group or a heterocyclic group.

In Formula (1), it is also preferred that Z and $R^1$ or $R^2$ and $R^3$ form a ring structure. The ring structure formed is a non-aromatic carbocyclic ring or a non-aromatic heterocyclic ring, preferably a 5-, 6- or 7-membered ring structure having a total carbon atom number including those of substituents of from 1 to 40, more preferably from 3 to 35.

One preferred compound among the compounds represented by Formula (1) is a compound where Z represents a cyano group, a formyl group, an acyl group, an alkoxycarbonyl group, an imino group or a carbamoyl group, $R^1$ represents an electron withdrawing group, and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, or a heterocyclic group. Furthermore, one preferred compound among the compounds represented by Formula (1) is a compound where Z and $R^1$ form a non-aromatic 5-, 6- or 7-membered ring structure in a combincation and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group an amino group, or a heterocyclic group.

Herein, the non-aromatic five to seven-membered ring structure are, specifically, indane-1,3-dioncyclic ring, pyrolidine-2,4-dion ring, pyrazolidine-3,5-dion ring, oxazolidine-2,4-dion ring, 5-pyrazolone ring, imidazolidine-2,4-dion ring, thiazolidine-2,4-dion ring, oxolane-2,4-dion ring, thiolane-2,4-dion ring, 1,3-dioxane-4,6-dion ring, cyclohexane-1,3-dion ring, 1,2,3,4-tetrahydroquinoline-2,4-dion ring, cyclopentane-1,3-dion ring, iso-oxazolidine-3,5-dion ring, barbituric acid ring, 2,3-dihydrobenzofuran-3-on ring, pyrazolotriazole ring (e.g., 7H-pyrazolo[1,5-b][1,2,4]triazole, 7H-pyrazolo[5,1-c][1,2,4]triazole, 7H-pyrazolo[1,5-a][1,2,4]benzimidazole), pyrrolotriazole ring (e.g., 5H-pyrrolo[1,2-b][1,2,4]triazole, 5H-pyrrolo[2,1-c][1,2,4]triazole), 2-cyclopentene-1,4-dion ring, 2,3-dihydrobenzothiophene-3-on-1,1-dioxide ring, chromane-2,4-dion ring, 2-thion ring, pyrrolopyrimidion ring, 1,3-dithiolane ring, thiazolidine ring, 1,3-dithiethane ring, 1,3-dioxolane ring. Preferred are, e.g., inter alia, indane-1,3-dioncyclic ring, pyrolidine-2,4-dion ring, pyrazolidine-3,5-dion ring, 5-pyrazolone ring, barbituric acid ring, and 2-oxazolidine-5-on ring.

As examples of a substituent represented by $R^4$ in Formula (2), the same substances can be exemplified as those described for the substituents of $R^1$ to $R^3$ in Formula (1).

The substituent represented by $R^4$ in Formula (2) is preferably an electron withdrawing group or an aryl group. When $R^4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a perfluoroalkyl group, a phosphoryl group, an imino group or a heterocyclic group, more preferably a cyano group, an acyl group, a formyl group, an alkoxycarbonyl group, a carbamoyl group, a sulfamoyl group, an alkylsulfonyl group, an arylsulfonyl group or a sulfonamide, or a heterocyclic group.

When $R^4$ represents an aryl group, the aryl group is preferably a substituted or unsubstituted phenyl group having a total carbon atom number of from 0 to 30. As for substituent, when $R^1$, $R^2$ or $R^3$ in Formula (1) represents a substituent, the same substituent can be exemplified but such a substituent is preferably an electron withdrawing group.

In Formula (3), the substituent represented by X or Y can be the same one described for the substituent for $R^1$, $R^2$, and $R^3$in Formula (1). The substituent represented by X or Y is preferably a substituent having a total carbon number of from 1 to 50, more preferably from 1 to 35, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group. More preferred are a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, and further more preferred are a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted by N atom, a heterocyclic group or a phenyl group substituted by any electron withdrawing group.

X and Y are also preferably combined with each other to form a non-aromatic carbon ring or a non-aromatic heterocyclic ring. The ring structure formed is preferably a 5-, 6-, or 7-membered ring, and more specifically, the rings can be the same as the examples of five- to seven-membered ring of the non-aromatic groups to be formed in combination of Z and $R^1$ in Formula (1) and have the same desirable range. Those rings may include a substituent, whose total carbon atom number is preferably from 1 to 40, more preferably from 1 to 35.

Those groups represented by A and B in Formula (3) may further have a substituent, and preferably, the group has a total carbon atom number from 1 to 40, more preferably from 1 to 30.

In Formula (3), A and B are more preferably combined with each other to form a ring structure. The ring structure formed is preferably a 5-, 6- or 7-membered non-aromatic heterocyclic ring having a total carbon atom number of from 1 to 40, more preferably from 3 to 30. In this situation, examples of the linked structure (—A—B—) formed by A and B include —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—Ph—O—, —N$(CH_3)$—Ph—S— and —N(Ph)—$(CH_2)_2$—S—.

Into the compound represented by Formula (1), (2) or (3) for use in the present invention, an adsorptive group capable of adsorbing to silver halide may be integrated. Also, a ballast group or polymer commonly used in immobile photographic additives such as a coupler may be integrated into the compound. The compound may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group). Examples of the groups include the groups described in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by Formulae (1) to (3) for use in the present invention are shown below. However, the present invention is by no means limited to the following compounds.

C-1

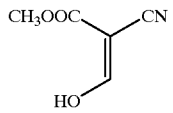

C-2

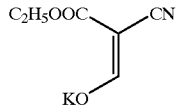

C-3

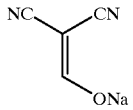

C-4

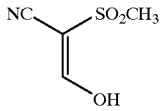

C-5

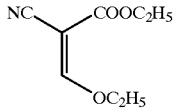

C-6

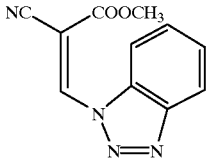

C-7

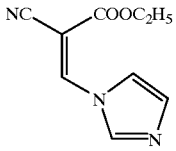

C-8

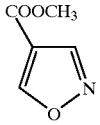

C-9

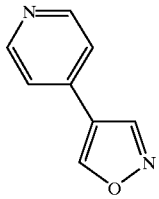

C-10

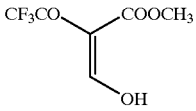

C-11

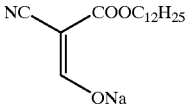

-continued
C-12
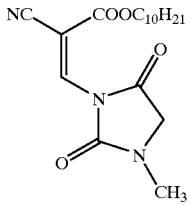
C-13
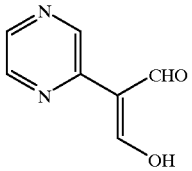
C-14
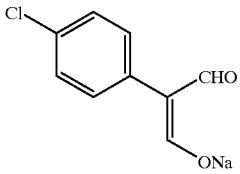
C-15
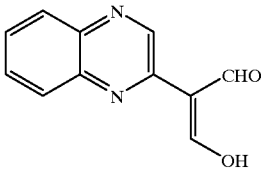
C-16
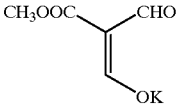
C-17
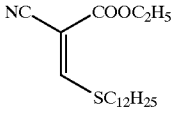
C-18
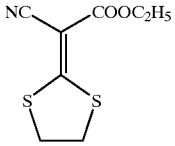
C-19
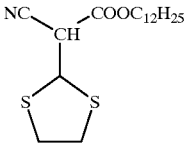
C-20
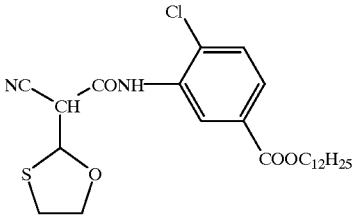
-continued
C-21
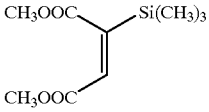
C-22
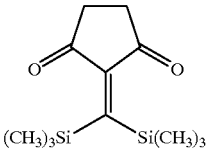
C-23
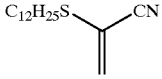
C-24
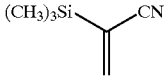
C-25
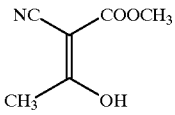
C-26
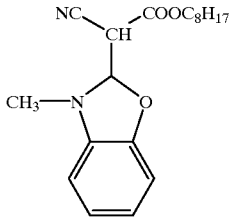
C-27
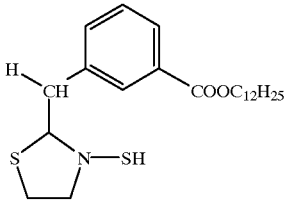
C-28
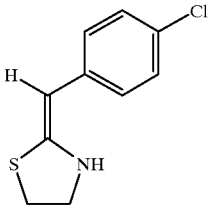
C-29
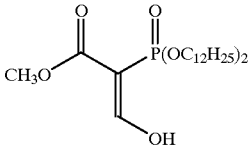
C-30
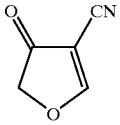

-continued
C-31
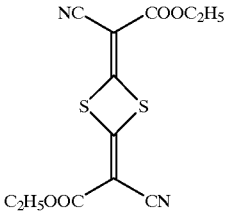
C-32
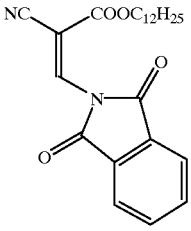
C-33
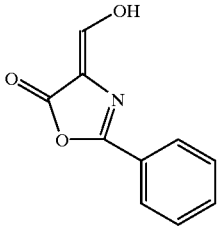
C-34
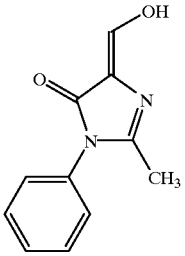
C-35
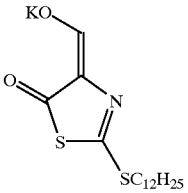
C-36
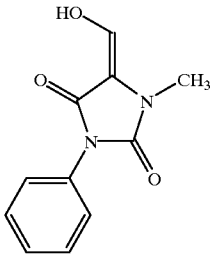
-continued
C-37
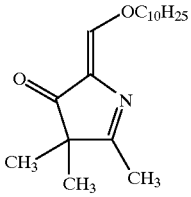
C-38
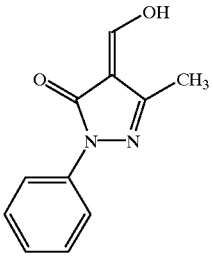
C-39
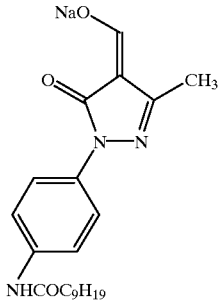
C-40
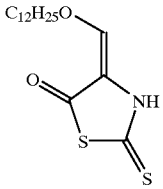
C-41
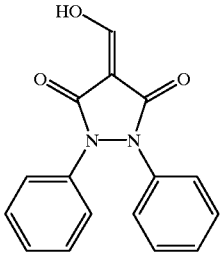
C-42
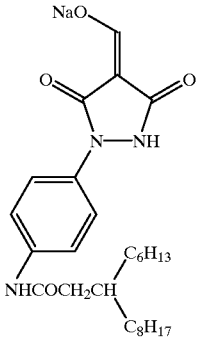

-continued
C-43
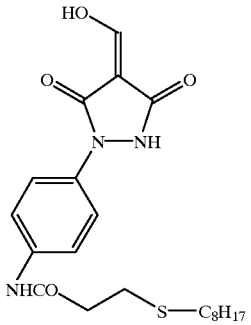
C-44
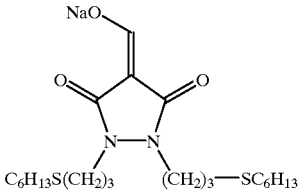
C-45
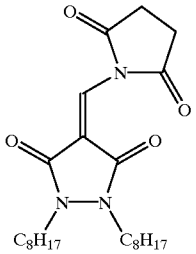
C-46
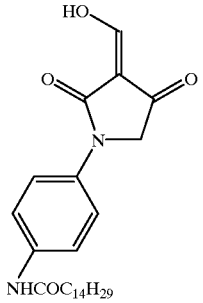
C-47
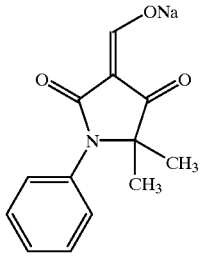
-continued
C-48
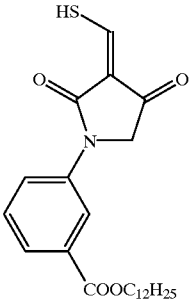
C-49
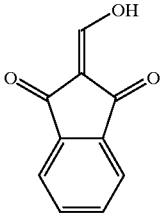
C-50
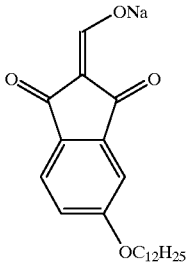
C-51
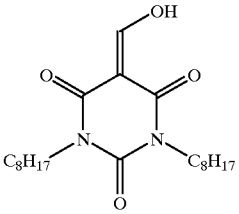
C-52
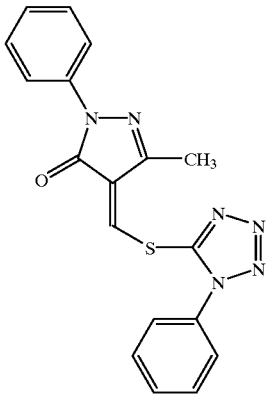

-continued
C-53
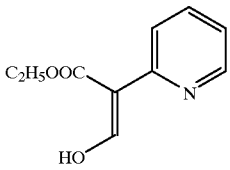
C-54
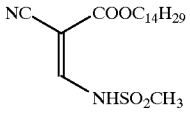
C-55
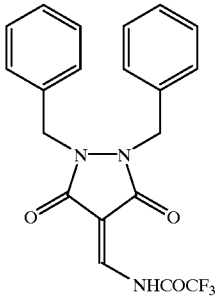
C-56
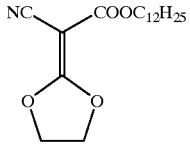
C-57
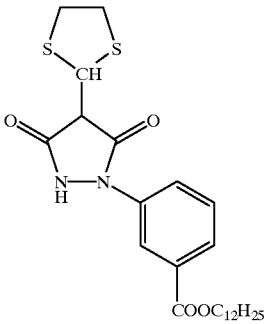
C-58
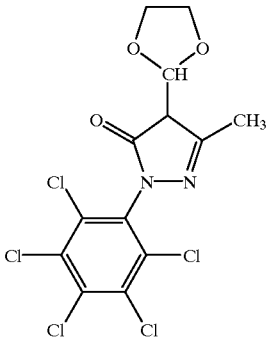
-continued
C-59
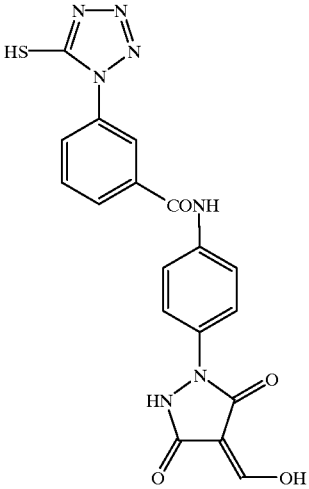
C-60
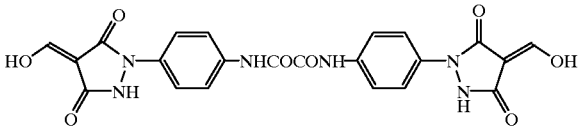
C-61
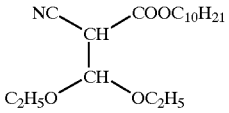
C-62
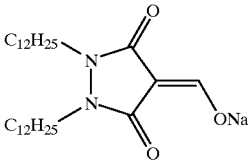
C-63
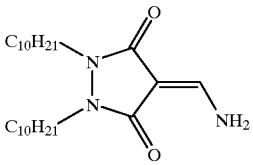
C-64
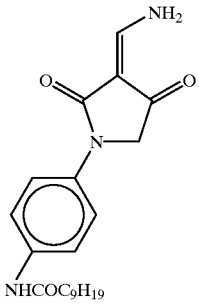

-continued

C-65

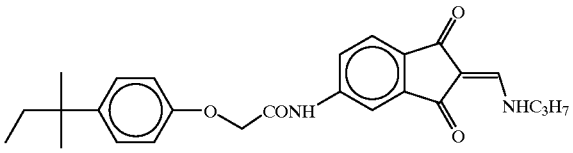

C-66

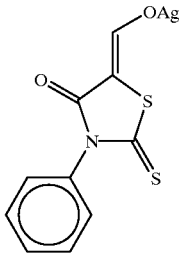

C-67

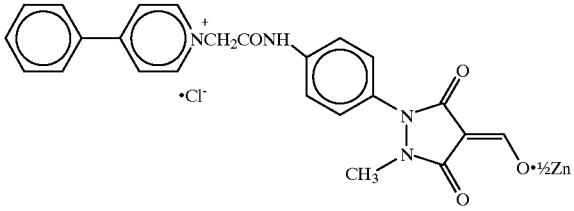

C-68

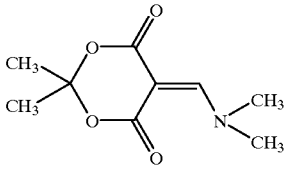

C-69

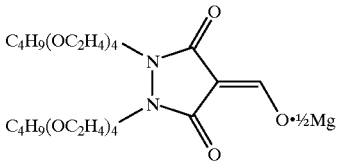

-continued

C-70

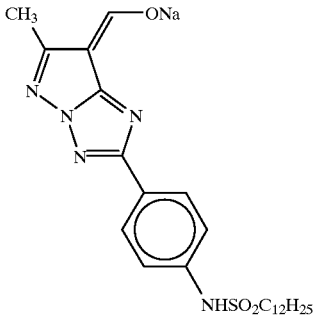

C-71

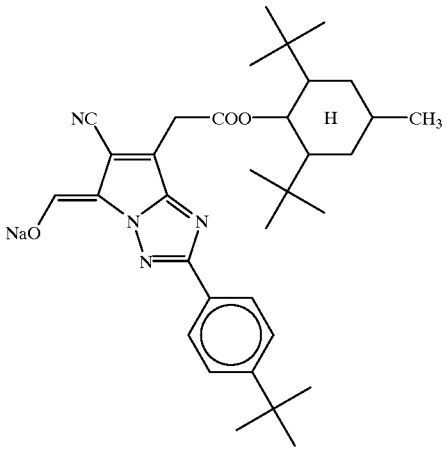

C-72

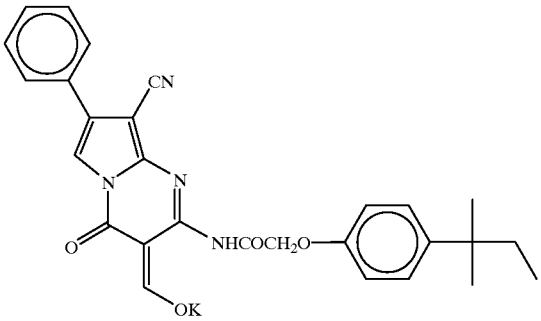

The compounds represented by Formulae (1) to (3) can be easily synthesized according to known methods and may be synthesized by referring, for example, to U.S. Pat. Nos. 5,545,515, 5,635,339 and 5,654,130, International Patent Publication WO97/34196 or Japanese Patent Application Nos. 9-354107, 9-309813 and 9-272002.

The compounds represented by Formulae (1) to (3) may be used individually or in combination of two or more thereof. In addition to these compounds, compounds described in U.S. Pat. Nos. 5,545,515, 5,635,339 and 5,654,130, U.S. Pat. No. 5,705,324, U.S. Pat. No. 5,686,228, JP-A-10-161270, Japanese Patent Application Nos. 9-273935, 9-354107, 9-309813, 9-296174, 9-282564, 9-272002, 9-272003 and 9-332388 may also be used in combination.

In the present invention, various hydrazine derivatives can be incorporated.

The compounds represented by Formulae (1) to (3) for use in the present invention each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the compounds each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds each may be used after dispersing the powder of the compound in an appropriate solvent such as water by a method known as a solid dispersion method, using a ball mill, a colloid mill or an ultrasonic wave.

The compounds represented by Formulae (1) to (3) for use in the present invention each may be added to a layer in the image recording layer side on the support, namely, an image-forming layer, or any other layers; however, the compounds each is preferably added to an image-forming layer or a layer adjacent thereto.

The addition amount of the compound represented by Formula (1), (2) or (3) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mol of silver.

In the present invention, various hydrazine derivatives as described in JP-A-10-161270 can be incorporated.

The hydrazine derivative desirably used in the present invention is preferably a compound represented by below Formula (H).

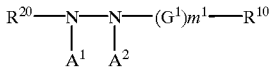

(H)

In Formula, $R^{20}$ represents an aliphatic group, an aromatic group or a heterocyclic group, $R^{10}$ represents a hydrogen atom or a block group, $G^1$ represents —CO—, —COCO—, —C(=S)—, —$SO_2$—, —SO—, —PO($R^{30}$)—(wherein $R^{30}$ is a group selected from the groups within the range defined for $R^{10}$, and $R^{30}$ may be different from $R^{10}$) , or an iminomethylene group. Both of $A^1$ and $A^2$ represent a hydrogen atom or one represents a hydrogen atom whereas the other represents a substituted or unsubstituted alkylsulfonyl group, a substituted or unsubstituted arylsulfonyl group, or a substituted or unsubstituted acyl group. A numeral $m^1$ represents 0 or 1 and when $m^1$ is 0, $R^{10}$ represents an aliphatic group, an aromatic group or a heterocyclic group.

Subsequently, the hydrazine derivatives used in the invention as represented by Formula (H) are described.

In Formula (H), the aliphatic group represented by $R^{20}$ is preferably a substituted or unsubstituted, linear, branched or cyclic alkyl group, an alkenyl group or an alkynyl group having from 1 to 30 carbon atoms.

The aromatic group represented by $R^{20}$ is a monocyclic or condensed cyclic aryl group, and examples thereof include, e.g., a phenyl group and a naphthalene group derived from a benzene ring and a naphthalene ring, respectively. The heterocyclic group represented by $R^{20}$ is a monocyclic or condensed cyclic, saturated or unsaturated, aromatic or non-aromatic heterocyclic group, and examples thereof include a pyridine ring, a pyrimidine ring, an imidazole ring, a pyrazole ring, a quinoline ring, an isoquinoline ring, a benzimidazole ring, a thiazole ring, a benzothiazole ring, a thiophene ring, a triazine ring, a morpholino ring, a piperidine ring and a piperazine ring, and a benzo[1,3]dioxole ring. The compound $R^{20}$ can be substituted with an arbitrary substituent.

$R^{20}$ is preferably an aryl group, an alkyl group, or an aromatic heterocyclic group, more preferably, a saturated or unsaturated phenyl group, a substituted alkyl group having a carbon number from one to three, or an aromatic heterocyclic group.

When $R^{20}$ represents a substituted alkyl group having a carbon number from one to three, $R^{20}$ is more preferably a substituted methyl group, particularly, a doubly substituted methyl group or triply substituted methyl group. When $R^{20}$ represents a substituted alkyl group, preferred examples are a t-butyl group, a dicyanomethyl group, a dicyanophenylmethyl group, a triphenylmethyl group (trityl group) diphenylmethyl group, a methoxycarbonyldiphenylmethyl group, a dicyanodiphenylmehyl group, a methylthiodiphenylmehyl group, and cyclopropyldiphenylmethyl group, and the like, and a trityl group among those is most preferable.

When $R^{20}$ represents an aromatic heterocyclic group, exemplified as a preferable heterocyclic group are, e.g., a pyridine ring, a quinoline ring, a pyrimidine ring, a triazine ring, a benzothiazole ring, a benzimidazole ring, and a thiophene ring.

In Formula (H), $R^{20}$ is, most preferably a substituted or non-substituted phenyl group.

In Formula (H), $R^{10}$ represents a hydrogen atom or a block group. The block group is specifically an aliphatic group (specifically, an alkyl group, an alkenyl group or an alkynyl group), an aromatic group (e.g., a monocyclic or condensed cyclic aryl group), a heterocyclic group, an alkoxy group, an aryloxy group, an amino group or a hydrazino group.

The alkyl group represented by $R^{11}$ is preferably a substituted or unsubstituted alkyl group having from 1 to 10 carbon atoms, and examples thereof include a methyl group, an ethyl group, a trifluoromethyl group, a difluoromethyl group, a 2-carboxytetrafluoroethyl group, a pyridiniomethyl group, a difluoromethoxymethyl group, a difluorocarboxymethyl group, a hydroxymethyl group, a methanesulfonamidomethyl group, a benzenesulfonamidomethyl group, a trifluorosulfonamidomethyl group, a trifluoroacetylmethyl group, a dimethylaminomethyl group, a phenylsulfonylmethyl group, an o-hydroxybenzyl group, a methoxymethyl group, a phenoxymethyl group, a 4-ethylphenoxymethyl group, a phenylthiomethyl group, a t-butyl group, a dicyanomethyl group, a diphenylmethyl group, a triphenylmethyl group, a methoxycarbonyldiphenylmethyl group, a cyanodiphenylmethyl group and a methylthiodiphenylmethyl group. The alkenyl group is preferably an alkenyl group having from 1 to 10 carbon atoms, and examples thereof include a vinyl group, a 2-ethoxycarbonylvinyl group, a 2-trifluoro-2-methoxycarbonylvinyl group, a 2,2-dicyanovinyl group, a 2-cyano-2-methoxycarbonylvinyl group, a 2-cyano-2-ethoxycarbonylvinyl group, and a 2-acetyl-2-ethoxycarbonylvinyl group. The aryl group is preferably a monocyclic or condensed cyclic aryl group, more preferably an aryl group containing a benzene ring, and examples thereof include a phenyl group, a perfluorophenyl group, a 3,5-dichlorophenyl group, a 2-methanesulfonamidophenyl group, a 2-carbamoylphenyl group, a 4,5-dicyanophenyl group, a 2-hydroxymethylphenyl group, 2,6-dichloro-4-cyanophenyl group and 2-chloro-5-octylsulfamoylphenyl group. The heterocyclic group is preferably a 5- or 6-membered, saturated or unsaturated, monocyclic or condensed heterocyclic group containing at least one nitrogen, oxygen or sulfur atom, and examples thereof include a morpholino group, a piperidino group (N-substituted), an imidazolyl group, an indazolyl group (e.g., 4-nitroindazolyl group), a pyrazolyl group, a triazolyl group, a benzoimidazolyl group, a tetrazolyl group, a pyridyl group, a pyridinio group, a quinolinio group, a quinolyl group, a hydantoyl group, and an imidazolidinyl group. The alkoxy group is preferably an alkoxy group having from 1 to 8 carbon atoms, and examples thereof include a methoxy group, a 2-hydroxyethoxy group, a benzyloxy group and a t-butoxy group. The amino group is preferably an unsubstituted amino group, an alkylamino group having from 1 to 10 carbon atoms, an arylamino group or a saturated or unsaturated heterocyclic amino group (including a nitrogen-containing heterocyclic amino group containing a quaternized nitrogen atom). Examples of the amino group include 2,2,6,6-tetramethylpiperidin-4-ylamino group, a propylamino group, a 2-hydroxyethylamino group, a 3-hydroxypropylmino group, an anilino group, an o-hydroxyanilino group, a 5-benzotriazolylamino group and an N-benzyl-3-pyridinioamino group. The group represented by $R^{10}$ may be substituted with an arbitrary substituent.

The preferred group represented by $R^{10}$ is described below. When $R^{20}$ is a phenyl group or an aromatic heterocyclic ring and $G^1$ is —CO— group, $R^{10}$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. In the case where $R^{10}$ represents an alkyl group, the substituent therefor is particularly preferably a halogen atom, an alkoxy group, an aryloxy group, an alkylthio group, an arylthio group, a carboxy group, a sulfonamide group, an amide group, acylamino group, and a carboxy group.

When $R^{20}$ is a substituted methyl group and $G^1$ is —CO— group, $R^{10}$ is preferably a hydrogen atom, an alkyl group, an aryl group, a heterocyclic group, an alkoxy group or an amino group (e.g., unsubstituted amino group, alkylamino group, arylamino group, heterocyclic amino group), more preferably a hydrogen atom, an alkyl group, an aryl group, a heterocyclic group, an alkoxy group, an alkylamino group, an arylamino group or a heterocyclic amino group. When $G^1$ is —COCO— group, $R^{10}$ is preferably, irrespective of $R^{20}$, an alkoxy group, an aryloxy group or an amino group, more preferably a substituted amino group, specifically, an alkylamino group, an arylamino group or a saturated or unsaturated heterocyclic amino group.

When $G^1$ is —$SO_2$— group, $R^{10}$ is preferably, irrespective of $R^{20}$, an alkyl group, an aryl group or a substituted amino group.

In Formula (H), $G^1$ is preferably —CO— or —COCO— group, more preferably —CO— group.

In Formula (H), $A^1$ and $A^2$ each represents a hydrogen atom, an alkyl group or arylsulfonyl group having 20 or less carbon atoms (preferably a phenylsulfonyl group or a phenylsulfonyl group substituted such that the sum of Hammett's substituent constants is −0.5 or more), an acyl group having 20 or less carbon atoms (preferably a benzoyl group, a benzoyl group substituted such that the sum of Hammett's substituent constants is −0.5 or more, or a straight-chain, branched or cyclic, substituted or unsubstituted aliphatic acyl group). $A^1$ and $A^2$ each is most preferably a hydrogen atom.

In Formula (H), $m^1$ represents 1 or 0. When $m^1$ is 0, $R^{10}$ is an aliphatic group, an aromatic group or a heterocyclic group, preferably a phenyl group, a substituted alkyl group having from 1 to 3 carbon atoms, or an alkenyl group. The phenyl group and the substituted alkyl group having from 1 to 3 carbon atoms among these groups have the same preferred range as described above for $R^{20}$. When $R^{10}$ belongs to an alkenyl group, $R^{10}$ is preferably a vinyl group and is further preferred to be a vinyl group having one or two substituents selected from the following substituents: a cyano group, an acyl group, an alkoxycarbonyl group, a nitro group, a trifluoromethyl group, a carbamoyl group, and the like. More specifically, $R^{10}$ may be selected from a group of a 2,2-dicyanovinyl group, 2-cyano-2-methoxycarbonylvinyl group, a 2-cyano-ethoxycarbonylvinyl group, and a 2-acetyl-ethoxycarbonylvinyl group.

Numeral $m^1$ is preferably 1.

In Formula (H), $R^{10}$ may be one which cleaves the $G^1$-$R^{10}$ moiety from the residual molecule and causes a cyclization reaction to form a cyclic structure containing the atoms in the -G'-$R^{10}$ moiety. Also, into the hydrazine derivative represented by Formula (H), an adsorptive group capable of adsorbing to silver halide may be integrated. Numeral $R^{10}$ or $R^{20}$ in Formula (H) may be one into which a ballast group or polymer commonly used in immobile photographic additives such as a coupler may be integrated. The $R^{10}$ or $R^{20}$ in Formula (H) may contain a plurality of hydrazino groups serving as the substituents. At this time, the compound represented by Formula (H) is a polymer product with respect to the hydrazino group. Moreover, the $R^{10}$ or $R^{20}$ in Formula (H) may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group). Examples thereof include those compounds described in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, JP-A-2-285344, JP-A-1-100530, JP-A-64-86134, JP-A-4-16938, JP-A-5-197091, WO95-32452, WO95-32453, JP-A9-235264, JP-A-9-235265, JP-A 9-235266, JP-A 9-235267, JP-A 9-179229, JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

The followings are specific examples of compounds shown by Formula (H). However, this invention is not limited to those compounds.

| | Y—NHNH—X | | | | |
|---|---|---|---|---|---|
| | X = | | | | |
| Y = | —CHO | —$COCH_2OH$ | —$COCH_2NHSO_2CH_3$ | —$COCH_2N(CH_3)_2$ | —CH=C(CN)$COOC_2H_5$ |
| 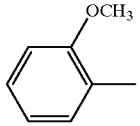 | 1a | 1b | 1c | 1d | 1e |
| 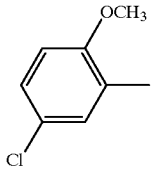 | 2a | 2b | 2c | 2d | 2e |
| 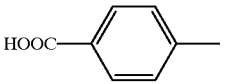 | 3a | 3b | 3c | 3d | 3e |
| 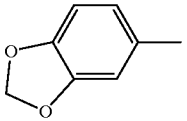 | 4a | 4b | 4c | 4d | 4e |
| 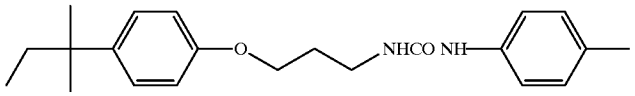 | 5a | 5b | 5c | 5d | 5e |

-continued
| | Y—NHNH—X | | | | |
|---|---|---|---|---|---|
| | X = | | | | |
| Y = | —CHO | —$COCH_2OH$ | —$COCH_2NHSO_2CH_3$ | —$COCH_2N(CH_3)_2$ | —$CH{=}C(CN)COOC_2H_5$ |
| 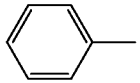 | 6a | 6b | 6c | 6d | 6e |
| 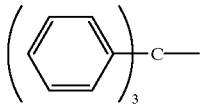 | 7a | 7b | 7c | 7d | 7e |
| 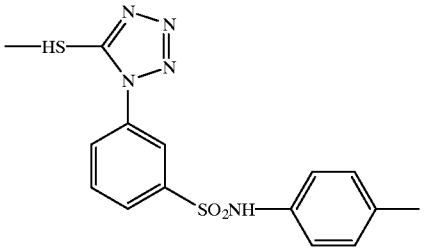 | 8a | 8b | 8c | 8d | 8e |

-continued
| | Y—NHNH—X | | | | |
|---|---|---|---|---|---|
| | X = | | | | |
| Y = | —CHO | —$COCH_2OH$ | —$COCH_2NHSO_2CH_3$ | —$COCH_2N(CH_3)_2$ | —$CH{=}C(CN)COOC_2H_5$ |
| 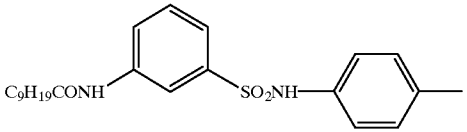 | 9a | 9b | 9c | 9d | 9e |
| 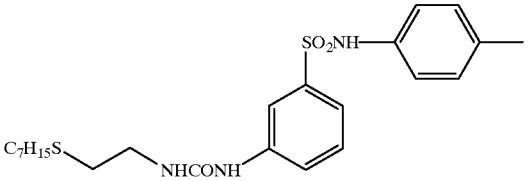 | 10a | 10b | 10c | 10d | 10e |

11
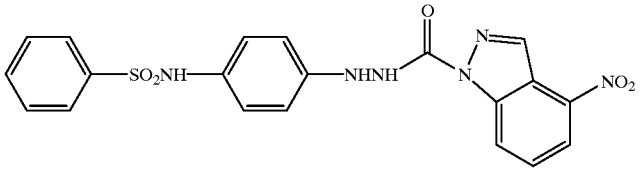
12
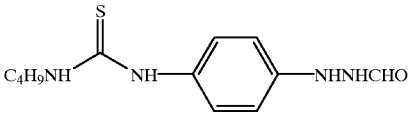
13
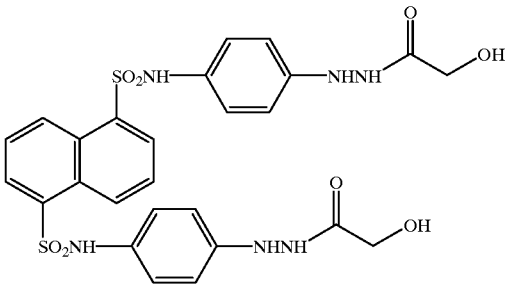
14
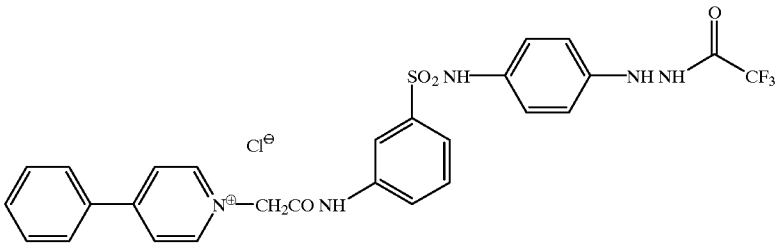
15
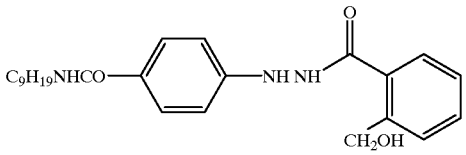
16
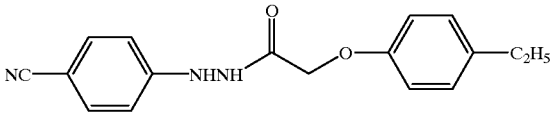
17
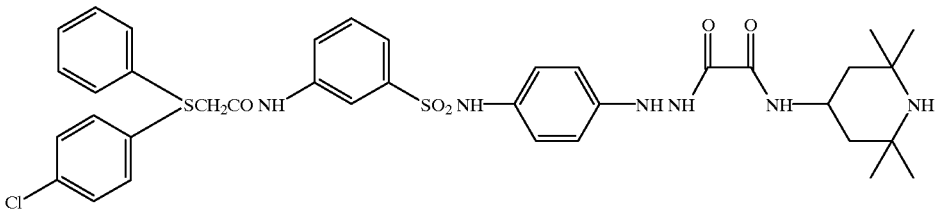

-continued

18

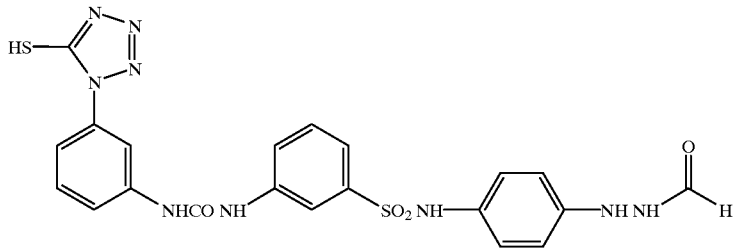

19

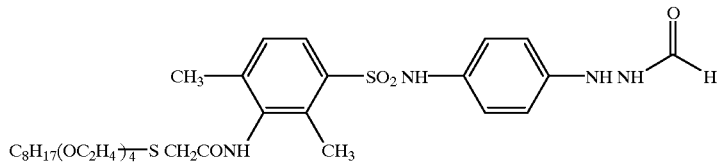

20

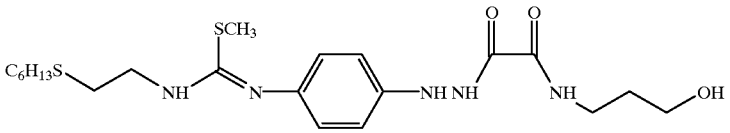

21

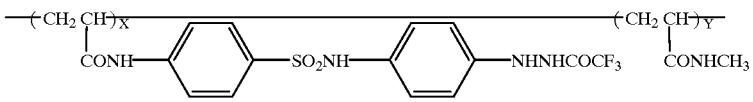

X:Y = 3:97 (mole ratio)
Average molecular weight 100,000

22

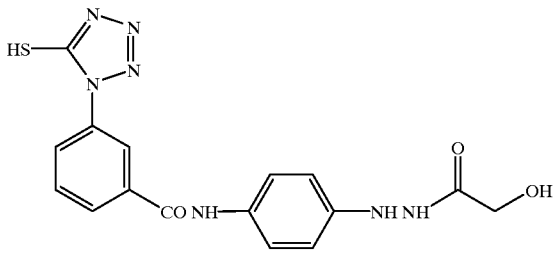

23

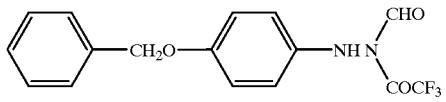

24

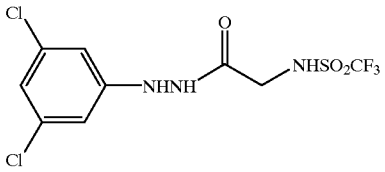

25

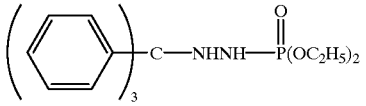

The hydrazine derivatives used in the present invention can be used with a single kind or two or more kinds of them. In addition to the above-described hydrazine derivatives, the hydrazine derivatives described below may also be preferably used in the present invention (depending on the case, the hydrazine derivatives may be used in combination). Furthermore, the hydrazine derivative for use in the present invention can be synthesized by various methods described in the following patent publications.

That is, exemplified are hydrazine derivatives described in, such as, JP-A-10-10672, JP-A-10-161270, JP-A-10-62898, JP-A-9-304870, JP-A-9-304871, JP-10-31282, U.S. Pat. No. 5,496,695, European Pat. No. 741320A.

The hydrazine based nucleation agent for use in the present invention may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydrazine based nucleation agent for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, they may be used after dispersing the powder of the hydrazine derivative in an appropriate solvent such as water by a method known as a solid dispersion method, using a ball mill, colloid mill or ultrasonic wave.

The hydrazine nucleation agent for use in the present invention may be added to any layers on the image-forming layer side on the support, i.e., the image forming layer or other layers on that layer side; however, the hydrazine nucleation agent is preferably added to an image forming layer or a layer adjacent thereto.

The addition amount of the hydrazine derivatives for use in the present invention is preferably from $1\times10^{-6}$ to 1 mol, more preferably from $1\times10^{-5}$ to $1\times10^{-1}$ mol, most preferably from $2\times10^{-5}$ to $2\times10^{-2}$ mol, per mol of silver.

The heat developable image recording material of the present invention may contain a sensitizing dye. The sensitizing dye may be any one of those that can spectrally sensitize the halogenated silver halide particles at a desired wavelength region when they are adsorbed on the halogenated silver halide particles. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), Item 1831X (August, 1978, page 437) and also in the references as referred to in them. In particular, sensitizing dyes having a color sensitivity suitable for spectral characteristics of light sources of various laser imagers, scanners, image setters, process cameras and the like can advantageously be selected.

Exemplary dyes for spectral sensitization to so-called red light from light sources such as He—Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338.

Spectral sensitization as to the wavelength region of from 750 to 1,400 nm from semiconductor laser light sources can advantageously be obtained with various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes particularly preferably used for the present invention are cyanine dyes having a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band have been disclosed in U.S. Pat. Nos. 5,510,236, 3,871,887 (Example 5), JP-A-2-96131, JP-A-59-48753 and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-B-49-25500, JP-B-43-4933, JP-A-59-19032, JP-A-59-192242 and the like.

The sensitizing dyes may be used in combination of two or more of them for the present invention. The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

Furthermore, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultrasonic wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Patent Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The amount of the sensitizing dye used in the present invention may be selected according to the performance such as sensitivity or fog; however, it is preferably from $10^{-6}$ to 1 mol, more preferably from $10^{-4}$ to $10^{-1}$ mol, per mol of silver halide in the photosensitive layer that is the image-forming layer.

The silver halide emulsion and/or organic silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The antifoggant which is preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

Although the antifoggant for use in the present invention may be added in any form of a solution, powder, solid microparticle dispersion materials and the like, the antifoggant is preferably added with solid microparticle dispersion materials in which water is used as a disperse medium in the case that the antifoggant is not water-soluble. The solid microparticle dispersion is performed using a known pulverization means (e.g., ball mill, vibrating ball mill, sand mill, colloid mill, jet mill, roller mill). At the time of solid microparticle dispersion, a dispersion aid may also be used.

Although not necessary for practicing the present invention, it is advantageous in some cases to add a mercury(II) salt as an antifoggant to the image-forming layer. Preferred mercury(II) salts for this purpose are mercury acetate and mercury bromide. The addition amount of mercury for use in the present invention is preferably from 1 n mol to 1 m mol, more preferably from 10 m mol to 100 $\mu$mol, per mol of silver coated.

The heat developable image recording material of the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-9-329863, JP-A-9-329864 and JP-A-9-281637. The benzoic acid compound for use in the present invention may be added to any site of the photosensitive material, but the layer to which the benzoic acid is added is preferably a layer on the surface having the image-forming layer such as a photosensitive layer, more preferably an organic silver salt-containing layer that is the image-forming layer. The benzoic acid compound for use in the present invention may be added at any step during the preparation of the coating solution. In the case of adding the benzoic acid compound to an organic silver salt-containing layer, it may be added at any step from the preparation of the organic silver salt until the preparation of the coating solution, but is preferably added in the period after the preparation of the organic silver salt and immediately before the coating. The benzoic acid compound for use in the present invention may be added in any form of a powder, solution, microparticle dispersion and the like, or may be added as a solution containing a mixture of the benzoic acid compound with other additives such as a sensitizing dye, a reducing agent and a color toner. The benzoic acid compound for use in the present invention may be added in any amount; however, the addition amount thereof is preferably from 1 $\mu$mol to 2 mol, more preferably from 1 m mol to 0.5 mol, per mol of silver.

The heat developable image recording material of the present invention may contain a mercapto compound, a disulfide compound or a thione compound so as to control the development by inhibiting or accelerating the development, improve the spectral sensitization efficiency or improve the storage stability before or after the development.

In the case of using a mercapto compound in the present invention, any structure may be used but those represented by Ar-SM or Ar-S-S-Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxy, amino, carboxy, alkyl (e.g., alkyl having one or more carbon atoms, preferably from 1 to 4 carbon atoms), and alkoxy (e.g., alkoxy having one or more carbon atoms, preferably from 1 to 4 carbon atoms). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, 2-[3-(9-carbazolyl)-propylimino]-3-(2-mercaptoethyl)-benzothiazoline and the like. However, the present invention is by no means limited thereto.

The amount of the mercapto compound added is preferably from 0.0001 to 1.0 mol, more preferably from 0.001 to 0.3 mol, per mol of silver in an emulsion layer.

In the image forming layer of the invention, polyhydric alcohols, serving as a plasticizer, (for example, glycerins and diols described in U.S. Pat. No. 2,960,404), can be used.

The pH of the image forming layer coating liquid of the invention is adjusted to be from 5.5 to 7.8, but an acid used during preparation preferably does not contain any halogen.

With this invention, the back layer preferably has a maximum absorption in a prescribed range of about 0.3 or higher and 2.0 or lower. If the prescribed range is 750 to 1,400 nm, it is preferable that the optical density is equal to or greater than 0.005 and less than 0.5 in a range of 750 to 360 nm, more preferably, that it is an antihalation layer having an optical density equal to or greater than 0.001 and less than 0.3. When the prescribed range is 750 nm or less, the antihalation layer preferably has a maximum absorption equal to or greater than 0.3 less than 2.0 before image forming in the prescribed range and an optical density equal to or greater than 0.001 and less than 0.3 after image forming in the range of 750 to 360 nm. There is no special limitation to a method for lowering the optical density down to the above range after forming images, and exemplified are a method lowering dye density by eliminating colors from heating as described in Belgian Patent No. 733,706, a method for lowering density by eliminating colors from light radiation as set forth in JP-A-54-17,833, and the like.

In the case when an antihalation dye is used in the present invention, the dye may be any compound so long as the compound has an objective absorption in the desired wavelength region, the Cabsorption in the visible region can be sufficiently reduced after the processing, and the antihalation layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049.

In this invention, the suitable binder for back layer is transparent or semitransparent, and generally colorless and can be a natural polymer, synthetic resin polymer or copolymer, and other media for forming films, such as: gelatin, Arabic rubber, poly(vinyl alcohol), hydroxyethylcellulose, cellulose acetate, cellulose acetate butyrate, poly(vinylpyrrolidone), casein, starch, poly(acrylic acid), poly(methymethacrylic acid), poly(vinyl chloride), poly(methacrylic acid), copoly(styrene-maleic anhydride), copoly(styrene-acrylonitrile), copoly(styrenebutadiene), poly(vinyl acetal) group such as poly(vinyl formal) and poly(vinyl butyral), poly (ester) group, poly(urethane) group, phenoxy resin, poly (vinylidene chloride), poly(epoxide), poly(carbonate) group, poly(vinyl acetate), cellulose ester group, poly(amide) group. The binder can be covered with water, organic solvent, or emulsion.

The total binder amount for back layer of the invention is from 0.01 to 10 g/m$^2$, more preferably from 0.5 to 5 g/m$^2$.

In the one side image recording material according to the invention, a matting agent can be added to a surface protection layer of a photosensitive emulsion layer and/or a back layer or a surface protection layer of a back layer to improve the conveyance property. The matting agent is fine particles of organic or inorganic compounds, which are generally water-insoluble. Arbitrary agents as a matting agent can be used, such as well-known in the art, e.g., organic matting agents described in specifications of U.S. Pat. No. 1,939,213, U.S. Pat. No. 2,701,245, U.S. Pat. No. 2,322,037, U.S. Pat. No. 3,262,782, U.S. Pat. No. 3,539,344, and U.S. Pat. No. 3,767,448, and inorganic agents described in specifications of U.S. Pat. No. 1,260,772, U.S. Pat. No. 2,192,241, U.S. Pat. No. 3,257,206, U.S. Pat. No. 3,370,951, U.S. Pat. No. 3,523,022, U.S. Pat. No. 3,769,020. For example, as examples of an organic compound that can be used as a matting agent, specifically, preferably used are: as a water-dispersing vinyl polymer, polymethylacrylate, polymethylmethacrylate, polyacrylonitrile, acrylonitrile-α-methylstyrene, polystyrene, styrene-divinylbenzene copolymer, polyvinyl acetate, polyethylene carbonate, polytetrafluoroethylene, and the like, as a cellulose derivative, methylcellulose, cellulose acetate, cellulose acetate propionate, and the like, as a starch derivative, carboxystarch, carboxynitrophenylstarch, urea-formaldehyde-starch reactant, and the like, as hardened gelatin in use of a known hardening agent, and hardened gelatin of micro capsule hollow particles upon coacervation hardening. As examples of inorganic compounds, silicon dioxide, titanium dioxide, magnesium dioxide, aluminum oxide, barium sulfate, calcium carbonate, sliver chloride that is made less sensitive by a known method, silver bromide of the same, glass, and diatomite can be used preferably. The matting agent can be used according to the necessity in mixing substances of different kinds. There is no special limitation on the size and shape of the matting agent, and the agent of any grain size can be used. It is preferable to use the grain size of 0.1 micron to 30 microns when this invention is implemented. The grain size profile of the matting agent can be narrow and wide. On the other hand, because the matting agent greatly affects the haze and surface luster of the sensitive material, it is preferable to design the grain size, the shape, and the grain size profile meeting to the condition corresponding to the necessity at a time of production of the matting agent or by mixing of plural matting agents.

It is a preferable embodiment that the matting agent is added to the back layer in this invention, and as a mat degree of the back layer the Beck smoothness is preferably from 2000 sec to 10 sec, and more preferably from 1500 sec to 50 sec. The Beck smoothness can be obtained from JIS P8119 and TAPPI T479.

In this invention, the matting agent is preferably contained in an outmost surface layer of the image recording material, a layer functioning as an outmost surface layer, and a layer closer to the external surface and preferably contained on a layer functioning as a so-called protection layer. The mat degree of the emulsion surface protection layer can be any one as far as the stardust problem does not occur, and it is preferable that the Beck smoothness is from 500 sec to 5000 sec, and particularly, from 500 sec to 2500 sec.

According to the present invention, the outermost layers on the image-forming layer side and/or the opposite side preferably contain a lubricant.

No particular limitation is imposed upon the lubricant used in the present invention, and any compound which, when present at the surface of an object, reduces the friction coefficient of the surface relative to that when the compound is absent can be used for this purpose.

Typical examples of the lubricant which can be used in the present invention include the silicone based lubricants disclosed in U.S. Pat. No. 3,042,522, British Patent No. 955,061, U.S. Pat. Nos. 3,080,317, 4,004,927, 4,047,958 and 3,489,567, British Patent No. 1,143,118 and the like, the higher fatty acid based, alcohol based and acid amide based lubricants disclosed in U.S. Pat. Nos. 2,454,043, 2,732,305, 2,976,148 and 3,206,311, German Patent Nos. 1,284,295, 1,284,294 and the like, the metal soaps disclosed in British Patent No. 1,263,722, U.S. Pat. No. 3,933,516 and the like, the ester based and ether based lubricants disclosed in U.S. Pat. Nos. 2,588,765, 3,121,060, British Patent No. 1,198,387, the taurine based lubricants disclosed in U.S. Pat. Nos. 3,502,473 and 3,042,222 and the like.

Specific examples of the lubricant preferably used include, CELLOSOL 524 (main ingredient is carnauba wax), POLYLON A, 393, H-481 (main ingredient is polyethylene wax), HIMICRON G-110 (main ingredient is ethylene bis-stearic acid amide), HIMICRON G-270 (main ingredient is stearic acid amide) (all from Chukyo Oil & Fat Co., Ltd.).

The amount of the lubricant used is 0.1–50% by weight, preferably 0.5–30% by weight of binder contained in a layer to which the lubricant is added.

The heat developable photographic emulsion used in this invention is structured of a single or more layers on the support. The structure of a single layer includes the organic silver salt, the silver halide, the developing agent, and the binder, and desired additional materials such as color adjuster, covering aid, and other aids. The structure of two layers includes the organic silver salt and the silver halide in the first emulsion layer (ordinarily a layer adjacent to the base), and some other components should be included in the second layer or both layers. However, a two layer structure is conceivable in which the entire components are contained in the sole emulsion layer and in which a protection layer is contained. The structure of multicolor photosensitive heat developable photographic material may contain a component of those two layers for each color, and a single layer may contain all components as set forth in U.S. Pat. No. 4,708,928. In the case of multi-dye multicolor photosensitive heat developable photographic material, each emulsion layer may held generally in being distinctive from one another by using functional or non-functional barrier layers between the respective photosensitive layers as set forth in U.S. Pat. No. 4,460,681.

A backside resistive heating layer described in U.S. Patent Nos. 4,460,681 and 4,374,921 may also be used in the photosensitive heat developable photographic image system.

A film hardening agent may be used for respective layers such as the photosensitive layer, the protection layer, and the back layer. As an example for the film hardening agent, exemplified are polyisocyanate groups as set forth in U.S. Pat. No. 4,281,060, JP-A-6-208,193, and the like, epoxy compound groups as set forth in U.S. Pat. No. 4,791,042 and the like, vinylsulfone based compound groups as set forth in JP-A-62-89048, and the like.

A surfactant can be used in this invention for improving the coating property, and the electrostatic property, and the like. As examples of the surfactant, any proper materials, such as nonion based, anion based, cation based, fluorine based and the like can be used. More specifically, exemplified are fluorine based polymer surfactants as set forth in JP-A-62-170,950, U.S. Pat. No. 5,380,644, and the like, fluorine based surfactants as set forth in JP-A-60-244,945, JP-A-63-188,135, and the like, polysiloxane based surfactants as set forth in U.S. Pat. No. 3,885,965, and the like, polyalkileneoxide as set forth in JP-A-6-301,140, anion based surfactants, and the like.

As a method for obtaining color images using the heat developable image recording materials of the invention, there is a method as set forth in JP-A-7-13,295, 10 page left column 43 line to 11 page left column line 40. As a stabilizer for color dying images, exemplified are British Patent No. 1,326,889, U.S. Pat. No. 3,432,300, U.S. Pat. No. 3,698,909, U.S. Pat. No. 3,574,627, U.S. Pat. No. 3,573,050, U.S. Pat. No. 3,764,337, and U.S. Pat. No. 4,042,394.

The heat developable photographic emulsion of the invention can be coated by various coating operations such as a dipping coating, a air knife coating, flow coating, and extrusion coating using a hopper as set forth in U.S. Pat. No. 2,681,294. Two or more layers, if desired, can be covered at the same time by a method as set forth in U.S. Pat. No. 2,761,791, and British Patent No. 837,095.

The heat developable photographic material of the invention may contain additional layers, for example, a dye reception layer for receiving movable dye images, non-transparent layer used when a reverse printing is made, a protection top coating layer, primer layers already known in the art of light heat photographic technology, and the like. The image recording material of the invention preferably can form images only with the single sheet of the image recording material, and it is preferable that the functional layers necessary for forming images such as an image receiving layer or the like are not in another material.

While the heat developable image recording material of the present invention may be developed by any method, development is usually performed by elevating the temperature of the image recording material after the imagewise exposure. As a preferable embodiment of a heat developing apparatus to be used, exemplified are heat developing apparatuses, as a type that a heat developable image recording material is made in contact with a heat source such as a heat roller or heat drum, described in JP-B-5-56499, Japanese Patent No. 684453, JP-A-9-292695, JP-A-297385, International Patent WO95/30934, as a non-contact type, described in JP-A-13,294, and nternational Patent WO97/28489, WO97/28488, and WO97/28487. More preferred is a non-contact type heat developing apparatus. A preferred development temperature is from 80 to 250° C., more preferably from 100 to 140° C. The development time is preferably from 1 to 180 seconds, more preferably from 10 to 90 seconds.

As a method to prevent processing irregularities and physical failures caused by size deviation during the heat development from occurring in the heat development image recording material of the invention, a method (so-called multistage heating method) is effective in which, after application of heats for five seconds or more at a temperature at 80° C. or higher but less than 115° C. (preferably 113° C. or less) so as not to produce any image, images are formed by heat development at a temperature of 110° C. or higher (preferably 130° C. or less).

Cooling after heat development is preferably made slowly, and the cooling speed from the developing temperature to 70° C. is at 200° C./min or lower, preferably 150 to 50° C./min.

The heat developable image recording material of the present invention may be light exposed by any method but the light source for the exposure is preferably a laser ray. The laser ray for use in the present invention is preferably one from a gas laser, YAG laser, dye laser, semiconductor laser or the like. The semiconductor laser and a second harmonic generation device may be used in combination.

The heat developable image recording material of the present invention has a low haze at the exposure and is liable to incur generation of interference fringes. For preventing the generation of interference fringes, a technique of entering a laser ray obliquely with respect to the image recording material disclosed in JP-A-5-113548 and a method of using a multimode laser disclosed in International Patent Publication WO95/31754 are known and these techniques are preferably used.

The heat developable image recording material of the present invention is preferably exposed such that the laser rays are overlapped and the scanning lines are not viewed as described in SPIE, Vol. 169, "Laser Printing", pages 116 to 128 (1979), JP-A-4-51043 and WO95/31754.

The present invention will be specifically explained with reference to following Examples. Materials, reagents, ratios, manipulations and the like shown in the following examples can be optionally changed so long as such change does not depart from the spirit of the present invention. Therefore, the scope of the present invention is not limited to the following examples.

EXAMPLE 1

<<Preparation of Silver Halide Emulsion>>

(Emulsion A)

Into 700 ml of water, 11 g of phthalized gelatin, 30 mg of potassium bromide and 10 mg of sodium benzene thiosulfonate were dissolved, and after adjusting the pH to 5.0 at a temperature of 40° C., 159 ml of an aqueous solution containing 18.6 g of silver nitrate and an aqueous solution containing 1 mol/l of potassium bromide, $5\times10^{-6}$ mol/l of $(NH_4)_2RhC_{15}(H_2O)$, and $2\times10^{-5}$ mol/l of $K_3IrC_{16}$ were added by the control double jet method over 6 minutes and 30 seconds while keeping the pAg at 7.7. Subsequently, 476 ml of an aqueous solution containing 55.5 g of silver nitrate and an aqueous halogen salt solution containing 1 mol/l of potassium bromide and $2\times10^{-5}$ mol/l of $K_3IrC_{16}$ were added by the control double jet method over 28 minutes and 30 seconds while keeping the pAg at 7.7. Thereafter, the pH was lowered to cause coagulation precipitation and then 0.17 g of Compound A and 23.7 g of deionized gelatin (calcium containing amount is 20 ppm) are adjusted to the pAg at 8.0 with the pH 5.9. The obtained particles had a mean particle size of 0.08 micron, a coefficient of variation of the projected area of 9%, and a (100) face ratio of 90% and were cubic particles.

The silver halide particles thus obtained was warmed to 60° C. and added with sodium benzene thiosulfonate in an amount of 76 micron mol per mol of silver, and after 3 minutes, sodium tiosulfate of 154 microns was added, ripened for 100, it was cooled to 40° C. after adding 4-hydroxy-6-methyl-1,3,3a,7-tetrazaindene of $5\times10^{-4}$ mol.

Subsequently, it was kept at 40° C., added with $12.8\times10^{-4}$ mol of the below sensitizing dye A and the compound B of $6.4\times10^{-3}$ mol in stirring those. After rapidly cooling it after 20 minutes, the preparation of silver halide emulsion A was finished.

Sensitizing Dye A:

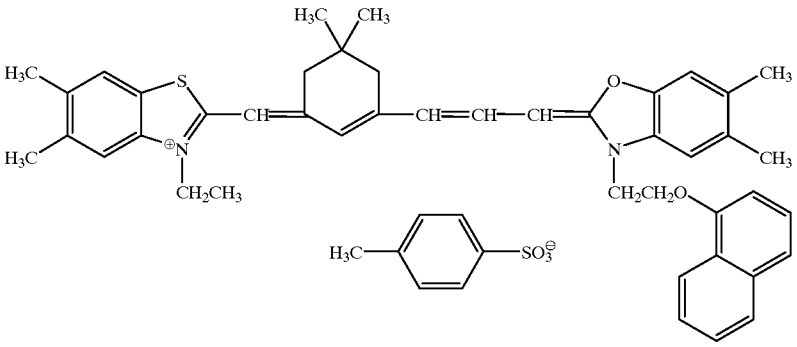

-continued

Compound A:

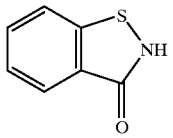

Compound B:

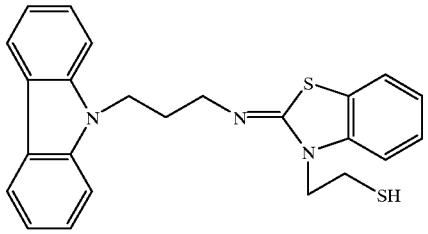

<<Preparation of organic silver salt dispersion>>

(Organic silver salt A)

123 ml of 1N aqueous NaOH solution was added to 6.1 g of arachic acid, 37.6 g of behenic acid, and 70 ml of tert-butanol in 700 ml of distilled water with stirring at 75° C. allowed to react for one hour, and cooled to 65° C. Then, 112.5 ml of an aqueous solution containing 22 g of silver nitrate was added over 45 seconds to the reaction mixture, which was then left as it was for 5 minutes to be cooled to 30° C. Thereafter, the solid content was separated by suction filtration, and the solid content was washed with water until the conductivity of the filtered water became 30 $\mu$S/cm. The solid content obtained as described above was handled as a wet cake without being dried. Polyvinyl alcohol (goods name: PVA-217) of 5 g and water are added to the wet cake corresponding to 100 g of dried solid portion, and it was adjusted to be 500 g as the whole weight and then preliminarily dispersed at a homo mixer.

Then, the original liquid already preliminarily dispersed was treated three times where the pressure of the dispersing machine (goods name: Microfluidizer M-110S-EH, Microfluidics International Corporation made, with G10Z interaction chamber) is adjusted to 1750 kg/M$^2$ and handled three times to obtain the organic silver salt dispersion A. The organic acid silver salt particles contained in the organic acid silver salt dispersion obtained as described above were acicular grains having an average minor axis length of 0.04 $\mu$m, an average major axis length of 0.8 $\mu$m and a variation coefficient of 30%. The measure the particle size is made by Master Sizer X made of Malvern Instruments Ltd. The cooling control is made by attaching the meander type heat exchangers in the front of and at the rear of the interaction chamber, and the desired dispersion temperature was set by adjusting the temperature of the coolant. Thus, the organic silver salt A having 85 mol % of behenic acid containing rare was prepared.

<<Preparation of solid micro-particle dispersion of 1,1-bis (2-hydroxy-3,5-dimethylphenyl)-3,5,5-trimethylhexane>>

To 20 g of 1,1-bis(2-hydroxy-3,5-dimethylphenyl)-3,5,5-trimethylhexane and 3.0 g of MP-203 of Kuray Co. made, 77 g of water was added and sufficiently stirred to form a slurry. The slurry was left for three hours. Subsequently, the slurry was introduced into a vessel together with 360 g of zirconia beads having an average particle size of 0.5 mm, and dispersed in a dispersing machine (1/4G Sand Grinder Mill, Imex Co., Ltd.) for 3 hours to prepare a reducing agent solid fine particle dispersion. The particle size was 0.3 micron or larger and 1.0 micron or less with 80% by weight of particles.

<<Preparation of solid fine particle dispersion of tribromomethylphenylsulfone>>

To 30 g of tribromomethylphenylsulfone, 0.5 g of hydroxypropylmethyl cellulose, and 0.5 g of a compound C, and 88.5 g of water were added and sufficiently stirred to form a slurry, which was left for three hours. Subsequently, in substantially the same manner as the reducing agent solid fine particle dispersion, a solid micro-particle dispersion for prevention agent was prepared. The particle size was 0.3 micron or larger and 1.0 micron or less with 80% by weight of particles.

<<Preparation of image forming layer coating liquid>>

To silver 1 mol of the thus produced organic silver salt fine particle dispersant, the following binders, materials, and a silver halide emulsion A are added, and adding water, a coating liquid was formed. The coating liquid had a pH of 7.5 to 7.7.

| | | |
|---|---|---|
| Binder; LACSTAR, 3307B as a solid portion, (Dainippon Ink & Chemicals, Inc., SBR latex, glass transition temperature Tg = 17° C.) | 406 | g |
| 1,1-bis(2-hydroxy-3,5-dimethylphenyl)-3,5,5-trimethylhexane as a solid portion, | 119 | g |
| tribromomethylphenylsulfone as a solid portion, | 21.6 | g |
| sodium benzene thiosulfonate | 0.44 | g |
| benzotriazole | 1.25 | g |
| polyvinyl alcohol (MP-203 (Kuraray Co., Ltd)) | 20 | g |
| cso-propylephthalazin | 0.10 | mol |
| orth-sodium dihydrogen phosphate | 0.13 | g |
| development suppressor A | 9.38 | g |
| nucleation agent: | | |
| dye A | kinds and mounts as set forth in Table 23 coating amount such that the optical density of 783 nonmagnetic is 0.3 | |
| silver halide emulsion A | 0.05 | mol as Ag amount |

Compound C:

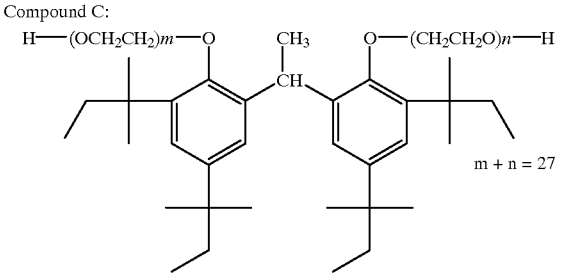

-continued

Compound D:

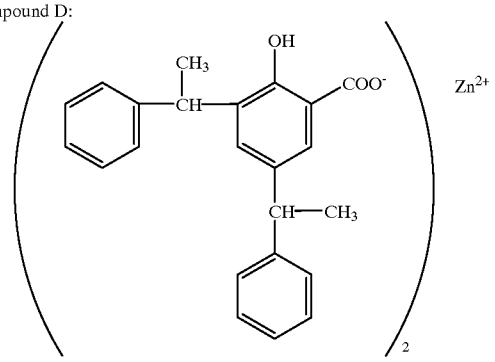

Dye A:

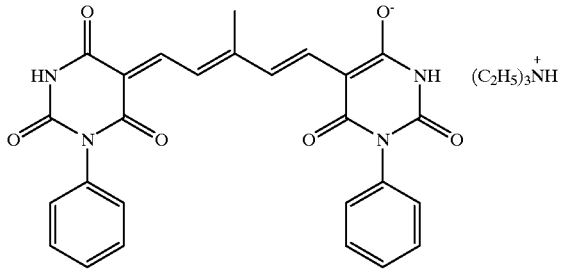

<<Preparation of coating liquid for lower protection layer>>

Water, 25 g was added to 150 g of a polymer latex shown in Tables 5, 6 (solid portion concentration 30% by weight; as a plasticizer, compound E (CS-12 made by Chisso Co.) of 15% by weight with respect to a polymer solid portion). Subsequently, adding 1.3 g of a water solution of 5% by weight of compound F, 50 g of a water solution of polyvinyl alcohol (PVA-235 made by Kurarey Co.) as a viscosity increasing agent, and 0.1 g of a matting agent (polystyrene particles having average particle size of 7 μm) to the liquid, a coating liquid was prepared. The coating liquid had a pH of 6.5 to 7.0.

<<Preparation of coating liquid for upper protection layer>>

To a polymer latex shown in Tables 5, 6 of 150 g (solid portion concentration 30% by weight; as a plasticizer, compound E of 15% by weight with respect to a polymer solid portion), 2.5 g of water solution of 5% by weight of compound F, 2.5 g of water disperse liquid of 30 wt % of carnauba wax (Chukyo Oil and Fat Co., Ltd. Cellosol 524), 46 g of a water solution of 5% by weight of polyvinyl alcohol (PVA-235 made by Kurarey) as a viscosity increasing agent, and 0.3 g of a matting agent (polystyrene particles having average particle size of 7 μm) were added, and further, 25 g of a water solution of 10% by weight of compound G was added to prepare a coating liquid. The pH of the coating liquid was 2.5 to 3.0.

Compound E:

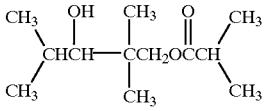

Compound F:

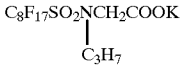

-continued

Compound G:

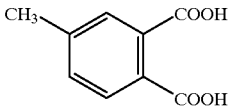

<<Production of PET support having back layer/undercoating layer>>

(1) Support

Using a terephthalic acid and an ethylene glycol, according to a normal method, a PET of IV (intrinsic viscosity)=66 (measured at 25° C. in phenol/tetrachloroethane=6/4 (ratio by weight)) was obtained. After this was made into pellets, they are dried for four hours at 130° C. After extruded from a T-shape die after melted at 300° C., the material was rapidly cooled, and non-drawn film was produced with a thickness such that the film thickness after getting thermal stability was 120 microns.

This film was longitudinally drawn 3.3 times using rollers having different peripheral speeds from one another and transversely drawn 4.5 times using a tenter. At that time, the temperatures are 110° C. and 130° C., respectively. Then, 4% relaxation was made in the transverse direction at the temperature of 240° C. after thermally stabilizing the film at the same temperature for 20 seconds. Subsequently, the chuck of the tenter was released, the both edges of the film were knurled, and the film was rolled at 4.8 kg/cm$^2$. Thus, a roll was obtained with a width of 2.4 m, a length of 3,500 m, and a thickness of 120 microns.

(2) Undercoating layer (a)

Polymer latex V-5

It was a latex of a core and shell type having a core portion of 90% by weight and a shell portion of 10% by weight. The core portion was made of vinylidene chloride/methylacrylate/methylmethacrylate/acrylonitrile/acrylic acid=93/3/3/0.9/0.1 (% by weight). The shell portion was made of vinylidene chloride/methylacrylate/methylmethacrylate/acrylonitrile/acrylic acid=88/3/3/3/3 (% by weight). Weight average molecular weight is 38000.

| | |
|---|---|
| Solid portion amount | 3.0 g/m$^2$ |
| 2,4-dichloro-6-hydroxy-s-triazine | 23 mg/m$^2$ |
| Matting agent (polystyrene, average diameter; 2.4 μm) | 1.5 mg/m$^2$ |
| (3) Undercoat layer (b) | |
| Alkali Processed gelatin ($Ca^{++}$ contained amount; 30 ppm, jelly strength; 230 g) | 83 mg/m$^2$ |
| Compound A | 1 mg/m$^2$ |
| Compound H | 2 mg/m$^2$ |
| Methyl cellulose | 4 mg/m$^2$ |
| Compound I | 3 mg/m$^2$ |
| (4) Electroconductive layer (surface resistivity $10^9$ Ω at 25° C., 25% RH) | |
| Julimer ET-410 (Nihon Junyaku Co., Ltd.) | 96 mg/m$^2$ |
| Gelatin | 72 mg/m$^2$ |
| Compound A | 0.2 mg/m$^2$ |
| Polyoxyethylenephenylether | 5 mg/m$^2$ |
| Sumitex Resin M-3 (water-soluble melamine compound, Sumitomo Chemical Industry (K.K.) made) | 18 mg/m$^2$ |
| Dye A (optical density of 783 nm ≧ 1.0) | 25 mg/m$^2$ |
| $SnO_2$/Sb (weight ratio; 9/1, needle shaped fine particles, major/minor axis = 20 to 30, Isihara Sangyo K.K. made) | 230 mg/m$^2$ |

-continued

| | |
|---|---|
| Matting agent (Polymethyl methacrylate, average particle size; 2.4 μm) | 0.5 mg/m$^2$ |
| Compound J | 2 mg/m$^2$ |
| (5) Back layer (1) | |
| Julimer ET-410 (Nihon Junyaku Co., Ltd.) | 95 mg/m$^2$ |
| Compound J | 2 mg/m$^2$ |
| Sumitex Resin M-3 (water-soluble melamine compound, Sumitomo Chemical Industry (K.K.) made) | 3 mg/m$^2$ |
| Carnauba wax (Chukyo Oil and Fat Co., Ltd. Cellosol 524) | 3 mg/m$^2$ |
| (6) Back layer (2) | |
| Back layer (2) has the same prescription as the undercoating layer (a). | |
| (7) Back layer (3) | |
| Polymer latex (3) (Tg ≈ 45° C.) (methyl methacrylate/styrene/2-ethylhexyl acrylate/2-hydroxyethyl methacrylate/acrylic acid = 59/9/26/5/1 (wt %, copolymer)) | 1000 mg/m$^2$ |
| Lubricant A | 21 mg/m$^2$ |
| Sumitex Resin M-3 (water-soluble melamine compound, Sumitomo Chemical Industry (K.K.) made) | 218 mg/m$^2$ |
| Surfactant; | |
| Compound example F-5 | 8 mg/m$^2$ |
| Compound example F-3 | 7 mg/m$^2$ |
| Matting agent (a copolymer of methylmethacrylate/acrylic acid - 97/3 by weight), average particle size; 5 μm) | 11 mg/m$^2$ |

Compound H:

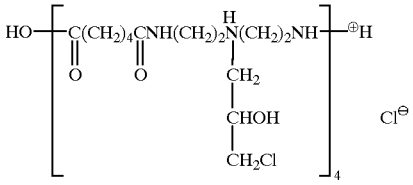

Compound I:

$C_{12}H_{25}O(CH_2CH_2O)_{10}H$

Compound J:

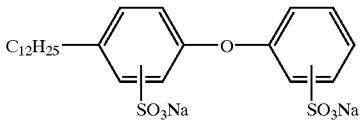

Lubricant A:

$C_{16}H_{33}OSO_3Na$

The undercoating layer (a) and the undercoating layer (b) were coated sequentially on one side of the support, and those were dried for four minutes at 180° C. Then, a conductive layer and back layers (1) to (3) were coated sequentially on the opposite side to the side where the undercoating layer (a) and the undercoating layer (b) were coated, and a PET support was produced with back/undercoating layers upon drying at 180° C. for 30 seconds.

Thus formed PET support with the back/undercoating layers was placed in thermal treatment zone extending in a whole length of 30 m set at a temperature of 150° C., and conveyed by its weight at a tension of 1.4 kg/cm$^2$ and feeding speed of 20 m/min. Thereafter, it passed a zone of 40° C. for 15 seconds, and was wound by winding tension of 10 kg/cm$^2$.

<<Preparation of the heat developable image recording material>>

On the side of the undercoating layer of the PET support where the electroconductive layer and the back layers (1) to (3) and the undercoating layers (a), (b) were coated, the above image forming layer and the lower and upper protection layers thereon were coated in a multilayer fashion at the same time as to make the coated sliver amount 1.6 g/m$^2$ and to make the coating amount of the polymer latex solid portion of the protection layer 1.5 g/m$^2$ at the lower layer and 2.5 g/m$^2$ at the upper layer, and dried at 70° C. drying temperature for three minutes, thereby producing a specimen. The obtained specimen was evaluated in the following manner.

(1) Evaluation of Photographic Ability

The obtained specimen was subject to a development processing in use of a heat developing apparatus shown in FIG. 1 by exposure with a xenon flash light of light emitting time of $10^{-6}$ second through an interference filter having a peak of 780 nm and a continuous concentration wedge. The term "correlative sensitivity" is a logarithmic value of a light exposure amount giving a concentration of 1.5 and indicated as a correlative value where the specimen number 1 is treated as 100. As for the numeral "γ", the γ value was sought by a gradient of a line that connects a point of a fog (fog concentration)+concentration of 0.3 with a point of a fog+concentration of 3.0 on the characteristic curve. In other words, it was sought according to the following formula.

$$\gamma=[3.0-0.3]/[\log(\text{exposure amount at the point of fog+concentration } 3.0)-\log(\text{exposure amount at the point of fog+concentration } 0.3)]$$

Dmax: maximum concentration of the characteristic curve.

(2) Evaluation of White Powder Occurrence

Using the heat developing apparatus shown in FIG. 1, after the light exposed specimen was developed, the specimen was left under conditions of 25° C., 40% RH for 24 hours, and then placed in a sealed bag and was subject to a thermal treatment for three days at 50° C. Existence of white powders on the specimen surface was evaluated by a five-level grading method.

5: Existed.

4: More or less existed.

2: Slightly existed.

0: Not existed.

The grade "3" is the intermediate level between the grade "4" and the grade "2" and the grade 1 is the intermediate level between the grade "2" and the grade "0." The grades "1" or "0" are required for practical use.

(3) Evaluation of Adherence Between the Image Forming Layer and the Protection Layer A sticky tape was adhered to a surface of the specimen treated in substantially the same way as the above (2), and the tape was peeled at a constant rate. The peeled degree of the protection layer at that time was evaluated by a five-level grading method. The grades "5" or "4" are required for practical use.

5: No peeled off

4: ¼ peeled off

3: ⅔ peeled off

2: ¾ peeled off

1: Entirely peeled off (4) Heat Developing Apparatus

FIG. 1 shows a heat developing apparatus used for heat developing process of the heat developable image recording material (specimens) in the above system. FIG. 1 shows a side view of the heat developing apparatus. The heat developing apparatus shown in FIG. 1 includes a feeding roller pair 11 (lower roller is the heating roller) for feeding the heat developable image recording material 10 in a plane manner in correcting and preheating the material 10 into a heating section and another feeding roller pair 12 for feeding the heat developable image recording material 10 in a plane manner in correcting the material 10 after heat development. The heat developable image recording material 10 is subject to heat development during feeding from the feeding roller pair 11 to the feeding roller pair 12. A conveying means for conveying the heat developable image recording material 10 during the heat development has a plurality of rollers 13 on a side with which a surface having the image forming layer is in contact, and a smooth surface 14 to which an aromatic polyamide made non-woven fabric is adhered is placed on a side in contact with the back surface in opposition to the above side. The heat developable image recording material 10 is conveyed by drive of the plural rollers 13 in contact with the surface having the image forming layer where the back surface slides on the smooth surface 14. As a heating means, heaters 15 are installed over the rollers 13 and below the smooth surface 14 so that the double sides of the heat developable image recording material 10 are heated. As the heating means in this situation, panel heaters and the like were used. The clearance between the rollers 13 and the smooth surface 14 may vary depending on the member of the smooth surface but is adjusted to a certain clearance capable of feeding the heat developable image recording material 10. It is preferably −0.5 to +0.5 mm. In this example, it was 0 mm.

The heating section was constituted of a preheating section A having the feeding roller pair 11 and a heat developing processing section B having the heaters 15. The preheating section A placed on an upstream side of the heat developing processing section B is preferably set at a temperature lower than the heat development temperature (e.g., 10 to 50° C. lower), as well as higher than the glass transition temperature (Tg) of the support of the heat developable image recording material 10, so as not to create development irregularity.

A guide plate 16 is disposed on a downstream side of the heat developing processing section B, and a slowly cooling section C is also disposed in having the feeding roller pair 12 (lower roller is the heater roller) and the guide plate 16. The guide plate is preferably made of a material having a low heat conducting rate, and cooling is preferably done gradually.

(5) Heat Development Condition

The heat development condition in this Example in use of the heat developing apparatus shown in FIG. 1 is as follows:

1) Preheating Section A (temperatures of the heat roller where the feeding roller pair 11 is set to (i) to (vi) from the upstream side)

| | | |
|---|---|---|
| Feeding roller pair 11: | (i) | 75° C. |
| (heat roller) | (ii) | 90° C. |
| | (iii) | 105° C. |
| | (iv) | 117° C. |
| | (v) | 121° C. |
| | (vi) | 121° C. |
| (total heating time: 17 seconds) | | |

2) Heat Developing Processing Section B (temperatures of upper and lower plate heaters where the heaters 15 are designated as (i) to (iii) from the upstream side)

Heaters 15: (i) upper/lower 122° C./122° C.
(ii) upper/lower 122° C./122° C.
(iii) upper/lower 122° C./122° C.
(total heating time: 17 seconds)

The aromatic polyamide non-woven fabric of the smooth surface 14 was a non-woven made of a Nomex aramid fabric (Dupont made).

3) Cooling section C Feeding roller pair 12 (temperature of the heat roller) 112° C.

| | |
|---|---|
| Cooling speed | 120° C./min |
| 4) Line speed | 20 mm/sec. |

(6) Evaluation Result

Obtained results are shown in Tables 5, 6. As apparent from Tables 5, 6, the specimens according to the invention have a good adherence between the image forming layer and the protection layer formed thereon after the heat development and are not subject to occurrence of white powders in enjoying a good photographic property. The specimen of the invention in which the protection layer (particularly, the upper protection layer) was made of a polymer having a Tg of 25 to 100° C. was desirable in terms of film strength and contact failure.

TABLE 5

| | Lower protection layer | | | Upper protection layer | | | Ratio of lower I/O to | Photographic ability | | | White | |
|---|---|---|---|---|---|---|---|---|---|---|---|---|
| No. | latex | Tg (° C.) | I/O | latex | Tg (° C.) | I/O | Upper I/O | C.sensitivity | γ | Dmax | powder | Adherence |
| 1 | — | — | — | P-15 | 100 | 0.09 | — | 100 | 20 | 4.3 | 5 | 5 |
| 2 | — | — | — | P-4 | 25 | 0.19 | — | 100 | 20 | 4.3 | 5 | 5 |
| 3 | — | — | — | P-5 | 20 | 0.24 | — | 100 | 20 | 4.3 | 5 | 5 |
| 4 | — | — | — | P-6 | 16 | 0.34 | — | 100 | 20 | 4.3 | 5 | 5 |
| 5 | — | — | — | P-1 | 46 | 0.49 | — | 100 | 20 | 4.3 | 5 | 5 |
| 6 | — | — | — | P-11 | 45 | 0.50 | — | 100 | 20 | 4.3 | 5 | 5 |
| 7 | — | — | — | P-3 | 31 | 0.53 | — | 100 | 20 | 4.3 | 4 | 5 |
| 8 | — | — | — | P-12 | 43 | 0.55 | — | 100 | 20 | 4.3 | 4 | 5 |
| 9 | — | — | — | P-13 | 44 | 0.60 | — | 100 | 20 | 4.3 | 2 | 4 |
| 10 | — | — | — | P-14 | 44 | 0.68 | — | 100 | 20 | 4.3 | 0 | 1 |
| 11 | — | — | — | P-9 | 12 | 0.83 | — | 100 | 20 | 4.3 | 0 | 1 |
| 12 | — | — | — | P-10 | 25 | 1.07 | — | 100 | 20 | 4.3 | 0 | 1 |
| 13 | P-6 | 16 | 0.34 | P-5 | 20 | 0.24 | 1.42 | 100 | 20 | 4.3 | 5 | 5 |
| 14 | P-6 | 16 | 0.34 | P-6 | 16 | 0.34 | 1.00 | 100 | 20 | 4.3 | 5 | 5 |
| 15 (invention) | P-6 | 16 | 0.34 | P-11 | 45 | 0.50 | 0.68 | 100 | 20 | 4.3 | 0 | 5 |

TABLE 5-continued

| No. | Lower protection layer latex | Lower protection layer Tg (° C.) | Lower protection layer I/O | Upper protection layer latex | Upper protection layer Tg (° C.) | Upper protection layer I/O | Ratio of lower I/O to Upper I/O | Photographic ability C.sensitivity | Photographic ability γ | Photographic ability Dmax | White powder | Adherence |
|---|---|---|---|---|---|---|---|---|---|---|---|---|
| 16 (invention) | P-6 | 16 | 0.34 | P-12 | 43 | 0.55 | 0.62 | 100 | 20 | 4.3 | 0 | 5 |
| 17 (invention) | P-6 | 16 | 0.34 | P-13 | 44 | 0.60 | 0.57 | 100 | 20 | 4.3 | 0 | 5 |
| 18 | P-1 | 46 | 0.49 | P-6 | 16 | 0.34 | 1.44 | 100 | 20 | 4.3 | 5 | 5 |
| 19 | P-1 | 46 | 0.49 | P-1 | 46 | 0.49 | 1.00 | 100 | 20 | 4.3 | 5 | 5 |
| 20 (invention) | P-1 | 46 | 0.49 | P-11 | 45 | 0.50 | 0.98 | 100 | 20 | 4.3 | 0 | 5 |

TABLE 6

| No. | Lower protection layer latex | Lower protection layer Tg (° C.) | Lower protection layer I/O | Upper protection layer latex | Upper protection layer Tg (° C.) | Upper protection layer I/O | Ratio of lower I/O to Upper I/O | Photographic ability C.sensitivity | Photographic ability γ | Photographic ability Dmax | White powder | Adherence |
|---|---|---|---|---|---|---|---|---|---|---|---|---|
| 21 (invention) | P-1 | 46 | 0.49 | P-3 | 31 | 0.53 | 0.92 | 100 | 20 | 4.3 | 0 | 5 |
| 22 (invention) | P-1 | 46 | 0.49 | P-12 | 43 | 0.55 | 0.89 | 100 | 20 | 4.3 | 0 | 5 |
| 23 (invention) | P-1 | 46 | 0.49 | P-13 | 44 | 0.60 | 0.82 | 100 | 20 | 4.3 | 0 | 5 |
| 24 (invention) | P-1 | 46 | 0.49 | P-9 | 12 | 0.83 | 0.59 | 100 | 20 | 4.3 | 0 | 5 |
| 25 (invention) | P-1 | 46 | 0.49 | P-10 | 25 | 1.07 | 0.46 | 100 | 20 | 4.3 | 0 | 5 |
| 26 | P-12 | 43 | 0.55 | P-11 | 45 | 0.50 | 1.10 | 100 | 20 | 4.3 | 4 | 5 |
| 27 | P-12 | 43 | 0.55 | P-12 | 43 | 0.55 | 1.00 | 100 | 20 | 4.3 | 4 | 5 |
| 28 (invention) | P-12 | 43 | 0.55 | P-13 | 44 | 0.60 | 0.92 | 100 | 20 | 4.3 | 0 | 5 |
| 29 (invention) | P-12 | 43 | 0.55 | P-14 | 44 | 0.68 | 0.81 | 100 | 20 | 4.3 | 0 | 5 |
| 30 (invention) | P-12 | 43 | 0.55 | P-9 | 12 | 0.83 | 0.66 | 100 | 20 | 4.3 | 0 | 5 |
| 31 (invention) | P-12 | 43 | 0.55 | P-10 | 25 | 1.07 | 0.51 | 100 | 20 | 4.3 | 0 | 5 |
| 32 | P-13 | 44 | 0.60 | P-12 | 43 | 0.55 | 1.09 | 100 | 20 | 4.3 | 2 | 4 |
| 33 | P-13 | 44 | 0.60 | P-13 | 44 | 0.60 | 1.00 | 100 | 20 | 4.3 | 2 | 4 |
| 34 (invention) | P-13 | 44 | 0.60 | P-14 | 44 | 0.68 | 0.88 | 100 | 20 | 4.3 | 0 | 4 |
| 35 (invention) | P-13 | 44 | 0.60 | P-9 | 12 | 0.83 | 0.72 | 100 | 20 | 4.3 | 0 | 4 |
| 36 (invention) | P-13 | 44 | 0.60 | P-10 | 25 | 1.07 | 0.56 | 100 | 20 | 4.3 | 0 | 4 |
| 37 | P-14 | 44 | 0.68 | P-10 | 25 | 1.07 | 0.64 | 100 | 20 | 4.3 | 0 | 1 |

EXAMPLE 2

The plasticizers of the lower and upper protection layers of the specimens of Nos. 15, 16, 17, 20 (this invention) and 19 (comparative specimen) in Example 1, only were placed with compounds K-1, K-2, K-8, and K-4, respectively. Each specimen was formed by adjusting the adding amount to 20% by weight with respect to the polymer latex solid portion, and those specimens were evaluated in substantially the same manner as those in Example 1. Consequently, any of those had good film forming property, and had a good adherence between the image forming layer and the protection layer formed thereon after the heat development and were not subject to occurrence of white powders in enjoying a good photographic property, in substantially the same way as Example 1.

EXAMPLE 3

In the specimens of Example 2, the amounts of the plasticizers of the lower and upper protection layers were changed to 10% by weight with respect to the polymer latex solid portion, and the same plasticizers as those contained in the protection layers of 10% by weight with respect to the polymer latex solid portion were added to the respective image forming layers to form specimens. As a result of evaluation made in the same way as Example 1, any of those had good film forming property, and the specimen of the invention had a good adherence between the image forming layer and the protection layer formed thereon after the heat development and were not subject to occurrence of white powders in enjoying a good photographic property, in substantially the same way as Example 1.

Thus, according to the invention, the material possesses good photographic property for photomechanical processes, has a good adherence between the image forming layer and the protection layer formed thereon after the heat development, and prevents white powders from occurring.

What is claimed is:

1. A heat developable image recording material comprising:

a support;

at least one image forming layer formed on the support; and a lower protection layer formed adjacent to and on the image forming layer and at least one other protection layer formed on the lower protection layer, wherein the lower protection layer comprises a polymer as a binder, in which I/O value of the polymer that is obtained by dividing inorganic value by organic value based on an organic conception diagram is equal to or less than 0.60, and wherein a ratio of the I/O value of the polymer contained as the binder of the lower protection layer to the I/O value of a polymer contained as a binder of the at least one other protection layer is less than 1.0.

2. The heat developable image recording material according to claim 1, wherein the lower protection layer contains a polymer having an I/O value of 0.10 to 0.55.

3. The heat developable image recording material according to claim 1, wherein the ratio is from 0.4 to 0.8.

4. The heat developable image recording material according to claim 1, wherein the image forming layer and the protection layer comprise a polymer latex as a binder.

5. The heat developable image recording material according to claim 4, wherein 50% by weight or greater of the binder contained in the image forming layer is the polymer latex.

6. The heat developable image recording material according to claim 4, wherein 80% by weight or greater of the binder contained in the image forming layer is the polymer latex.

7. The heat developable image recording material according to claim 1, wherein the image forming layer contains an organic silver salt, a reducing agent, and a photosensitive silver halide.

8. The heat developable image recording material according to claim 1, wherein a nucleation agent is at least one compound selected from substituted alkene derivatives represented by Formula (1), substituted isoxazoles derivative represented by Formula (2), specific compounds represented by Formula (3), and hydrazine derivatives represented by Formula (H), (1)

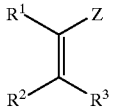

(2)

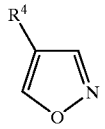

(3)

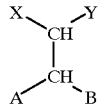

in Formula (1), $R^1$, $R^2$ and $R^3$ each independently represents a hydrogen atom or a substituent, Z represents an electron withdrawing group, $R^1$ and Z, $R^2$ and $R^3$, $R^1$ and $R^2{}_1$, or $R^3$ and Z may be combined with each other to form a non-aromatic carbocyclic ring or a non-aromatic heterocyclic ring; in Formula (2), $R^4$ represents a substituent; and in Formula (3), X and Y each independently represents a hydrogen atom or a substituent, A and B each independently represents an alkoxy group, an alkylthio group, an alkylamino group, an aryloxy group, an arylthio group, an anilino group, a heterocyclic oxy group, a heterocyclic thio group or a heterocyclic amino group, and X and Y, as well as A and B may be combined with each other to form a non-aromatic carbocyclic ring or a non-aromatic heterocyclic ring;

wherein the hydrazine derivative is a compound as represented by Formula (H), (H)

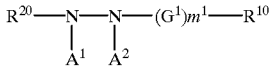

in formula, $R^{20}$ represents an aliphatic group, an aromatic group or a heterocyclic group, $R^{10}$ represents a hydrogen atom block group, $G^1$ represents —CO, —COCO—, —C(=S)—, —$SO_2$—, —SO—, —PO($R^{30}$)—, wherein $R^{30}$ is a group selected from the groups defined for $R^{10}$, and $R^{30}$ may be different from $R^{10}$, or an iminoethylene group, $A^1$ and $A^2$ both represents a hydrogen atom or either one represents a hydrogen atom and the other represents a substituted or unsubstituted alkylsulfonyl group, a substituted or unsubstituted arylsulfonyl group, or a substituted or unsubstituted acyl group, and $m^1$ represents 0 or 1 and when $m^1$ is 0, $R^{10}$ represents an aliphatic group, an aromatic group or a heterocyclic group.

9. The heat developable image recording material according to claim 1, wherein at least one layer selected from a layer containing a metal oxide or a layer containing a surfactant including fluorine is formed on at least one side of the support.

10. The heat developable image recording material according to claim 1, wherein the binder of the protection layer has a glass transition temperature of 25 to 100° C.

11. The heat developable image recording material according to claim 1, further comprising, on each side of the support, an undercoating layer comprising a vinylidene chloride copolymer containing at least 70% by weight of vinylidene chloride monomer repeating units.

12. The heat developable image recording material according to claim 8, wherein substituents are selected from the group consisting of a halogen atom, an alkyl group, an alkenyl group, an alkynyl group, an aryl group, a heterocyclic group, a quaternized nitrogen-containing heterocyclic group, an aryloxycarbonyl group, a carbamoyl group, a carboxy group or a salt thereof, an imino group, an imino group substituted by a N atom, a thiocarbonyl group, a sulfonylcarbamoyl group, an acylcarbamoyl group, a sulfamoylcarbamoyl group, a carbazoyl group, an oxayl group, an oxamoyl group, a cyano group, a thiocarbamoyl group, a hydroxy group or a salt thereof, an alkoxy group, an aryloxy group, a heterocyclic oxy group, an acyloxy group, an alkoxycarbonyl group, an aryloxycarbonyloxy group, a carbamoyloxy group, a sulfonyloxy group, an amino group, an alkylamino group, arylamino group, a heterocyclic amino group, an acylamino group, a sulfonamide group, a ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group or salt thereof, an alkylthio group, arylthio group, heterocyclic thio group, acylthio group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or salt thereof, a phosphoryl group, a group containing phosphoramide or phosphoric acid ester structure, a silyl group, and stannyl group.

13. The heat developable image recording material according to claim 8, wherein the block group is selected from the group consisting of an alkyl group, an alkenyl group, an alkynyl group, a monocyclic or condensed cyclic aryl group, a heterocyclic group, an alkoxy group, an aryloxy group, an amino group and a hydrazino group.

* * * * *